US011079707B2

(12) United States Patent
Kokubo et al.

(10) Patent No.: US 11,079,707 B2
(45) Date of Patent: Aug. 3, 2021

(54) MEDIUM PROCESSING APPARATUS

(71) Applicant: Oki Data Corporation, Tokyo (JP)

(72) Inventors: Iori Kokubo, Tokyo (JP); Kenichi Funatsu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/906,923

(22) Filed: Jun. 19, 2020

(65) Prior Publication Data

US 2020/0409296 A1 Dec. 31, 2020

(30) Foreign Application Priority Data

Jun. 26, 2019 (JP) ..... JP2019-118385

(51) Int. Cl.
*G03G 15/00* (2006.01)

(52) U.S. Cl.
CPC ..... *G03G 15/5016* (2013.01)

(58) Field of Classification Search
CPC ..... G03G 15/5016
See application file for complete search history.

(56) References Cited

U.S. PATENT DOCUMENTS

2009/0060564 A1* 3/2009 Sato ..... G03G 15/5016 399/107
2017/0371285 A1* 12/2017 Tanaka ..... B65H 43/00
2019/0049890 A1* 2/2019 Sugiura ..... G03G 15/2064

FOREIGN PATENT DOCUMENTS

JP 2014-016917 A 1/2014

* cited by examiner

*Primary Examiner* — G. M. A Hyder
(74) *Attorney, Agent, or Firm* — Rabin & Berdo, P.C.

(57) ABSTRACT

A medium processing apparatus includes a processor that performs a process related to a medium. The medium processing apparatus includes a discharging section, an operation section, and an operation controller. The discharging section discharges the medium. The operation section is disposed downstream of the discharging section in a discharging direction and includes a touch sensor. The discharging direction is a direction in which the discharging section discharges the medium. The touch sensor detects an operation input. The operation controller limits, on the basis of size information, detection operation performed by the touch sensor. The size information indicates information related to a medium size of the medium.

20 Claims, 27 Drawing Sheets

77A

| KEY GROUP G1 | KEY GROUP G2 |
|---|---|
| ▽ | △ |
| HELP | ONLINE |
| 7 | 1 |
| 8 | 2 |
| 9 | 3 |
| * | |
| 0 | |
| C | |

FIG. 24

MEDIUM PROCESSING APPARATUS

CROSS REFERENCE TO RELATED APPLICATIONS

The present application claims priority from Japanese Patent Application No. 2019-118385 filed on Jun. 26, 2019, the entire contents of which are hereby incorporated by reference.

BACKGROUND

The technology relates to a medium processing apparatus that performs a process related to a medium.

An apparatus that performs a process related to a medium encompasses, for example but not limited to, an image forming apparatus that forms an image on a medium and an image acquiring apparatus that acquires an image printed on a medium. Such apparatuses that perform often include a touch panel that receives user operation. Japanese Unexamined Patent Application Publication No. 2014-16917 discloses a multi-function peripheral (MFP) that prevents erroneous operation resulting from an unintentional touch input by a user in a case where a part of the user, such as the user's hand, arm, head, or body, touches or approaches a touch panel without the user being aware of such a situation.

SUMMARY

It is desired to reduce a possibility that erroneous operation is performed in a medium processing apparatus and it is expected to further prevent such erroneous operation.

It is desirable to provide a medium processing apparatus that makes it possible to reduce a possibility that erroneous operation is performed.

According to one embodiment of the technology, there is provided a medium processing apparatus including a processor that performs a process related to a medium. The medium processing apparatus includes a discharging section, an operation section, and an operation controller. The discharging section discharges the medium. The operation section is disposed downstream of the discharging section in a discharging direction and includes a touch sensor. The discharging direction is a direction in which the discharging section discharges the medium. The touch sensor detects an operation input. The operation controller limits, on the basis of size information, detection operation performed by the touch sensor. The size information indicates information related to a medium size of the medium.

According to one embodiment of the technology, there is provided a medium processing apparatus including a processor that performs a process related to a medium. The medium processing apparatus includes a discharging section, an operation section, and an operation controller. The discharging section discharges the medium. The operation section includes a touch sensor. The touch sensor detects an operation input. The operation controller controls operation of the operation section. A portion or all of the operation section is covered with the medium in a case where a medium size of the medium discharged from the discharging section is greater than a predetermined size. The operation controller limits the detection operation performed by the touch sensor in the case where the medium size is greater than the predetermined size.

According to one embodiment of the technology, there is provided a medium processing apparatus including a processor that performs a process related to a medium. The medium processing apparatus includes a housing, a placing section, a discharging section, an operation section, and an operation controller. The housing includes a first end and a second end. The second end is opposed to the first end. The placing section is disposed between the first end and the second end. The placing section is a section on which the medium subjected to the process is to be placed. The discharging section is disposed between the first end and the placing section. The discharging section discharges the medium subjected to the process to the placing section. The operation section is disposed between the placing section and the second end. The operation section includes a touch sensor. The touch sensor detects an operation input. The operation controller controls operation of the operation section. A portion or all of the operation section overlaps the discharging section in a direction intersecting a direction from the first end toward the second end. The operation controller limits, on the basis of size information, the detection operation performed by the touch sensor. The size information indicates information related to a medium size of the medium.

BRIEF DESCRIPTION OF THE DRAWINGS

FIG. 24 is an explanatory diagram illustrating a configuration example of key data illustrated in FIG. 22.

DETAILED DESCRIPTION

Figure 1:
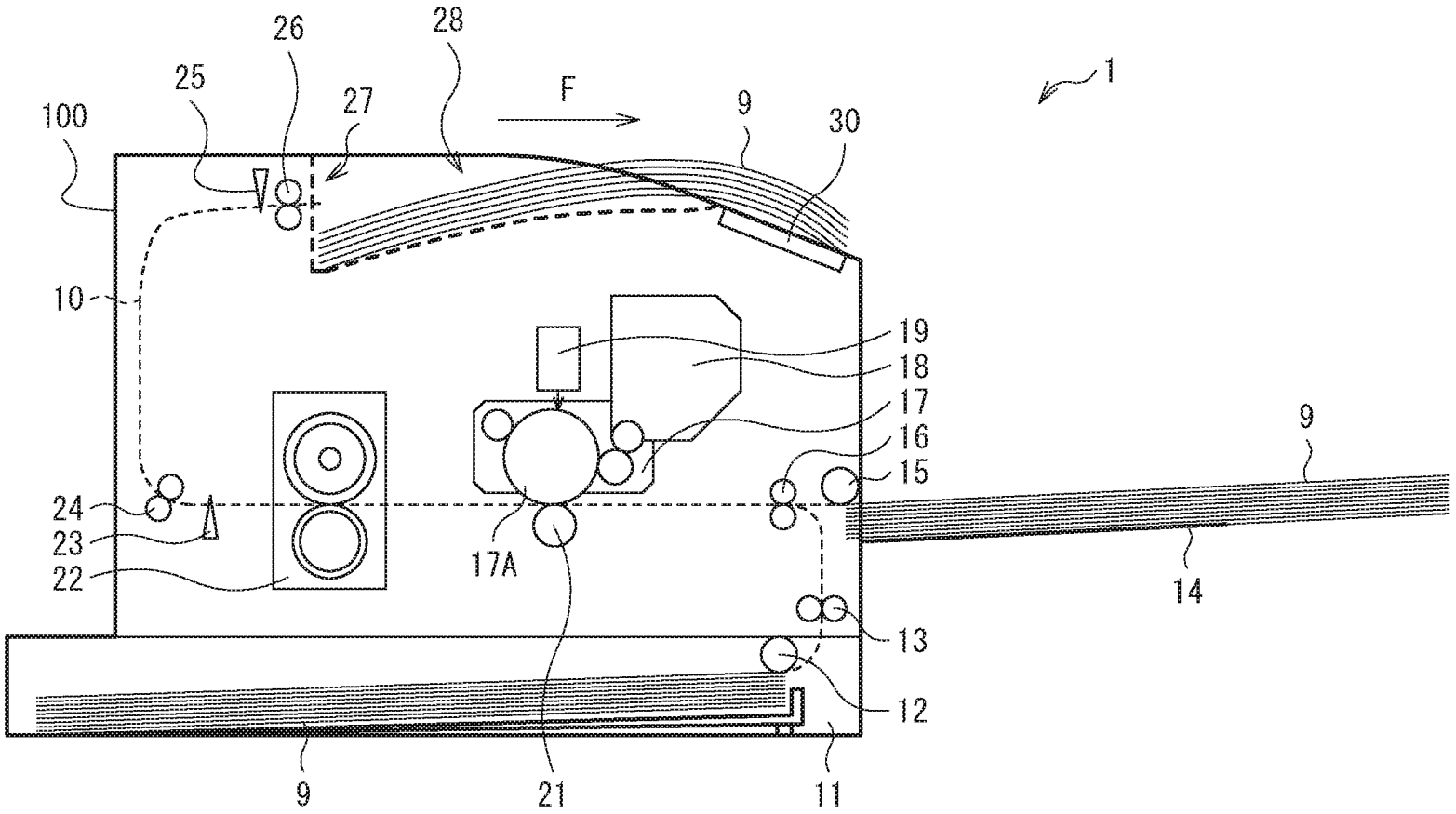
FIG. 1 is a diagram illustrating a configuration example of an image forming apparatus according to an example embodiment.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. First Example Embodiment
2. Second Example Embodiment

1. First Example Embodiment

Configuration Example

FIG. 1 illustrates a configuration example of a medium processing apparatus (an image forming apparatus 1) according to a first example embodiment of the technology. The image forming apparatus 1 may serve as a printer that forms an image on a medium by an electrophotographic method. Non-limiting examples of the medium may include plain paper. The image forming apparatus 1 may include, for example but not limited to, a medium cassette 11, a medium feeding roller 12, a conveying roller 13, a medium tray 14, a medium feeding roller 15, a conveying roller 16, an image forming unit 17, a toner container 18, an exposure section 19, a transfer roller 21, a fixing section 22, a medium sensor 23, a conveying roller 24, a medium sensor 25, a discharging roller 26, a discharging slot 27, a discharging tray 28, and an operation panel 30 that are contained in a housing 100.

The medium cassette 11 may contain recording media 9. The medium feeding roller 12 may pick up the recording media 9 contained in the medium cassette 11 one by one from the top, and feed the picked-up medium 9 to a conveyance path 10. The conveying roller 13 may include a pair of rollers with the conveyance path 10 interposed in between, and convey the medium 9 along the conveyance path 10.

The medium tray 14 may be a tray on which the medium 9 is to be placed. The medium tray 14 may be configured to allow various kinds of recording media 9 having various sizes to be placed on the medium tray 14. Non-limiting examples of such a medium 9 may include a long medium which is not containable in the medium cassette 11. The medium feeding roller 15 may pick up the recording media 9 placed on the medium tray 14 one by one from the top, and feed the picked-up medium 9 to the conveyance path 10.

The conveying roller 16 may convey the medium 9, which has been conveyed from any of the medium cassette 11 and the medium tray 14, toward the image forming unit 17 along the conveyance path 10.

The image forming unit 17 may form a toner image. The image forming unit 17 may include a photosensitive drum 17A. The photosensitive drum 17A may have a surface, or a surficial portion, that carries the toner image. For example, an electrostatic latent image may be formed on the surface of the photosensitive drum 17A as a result of exposure performed by the exposure section 19, and a toner image based on the electrostatic latent image may be formed on the surface of the photosensitive drum 17A. The toner container 18 may contain a toner, and feed the contained toner to the image forming unit 17. The exposure section 19 may apply light to the photosensitive drum 17A of the image forming unit 17. The exposure section 19 may include, for example but not limited to, two or more light-emitting diodes that are disposed side by side in a main scanning direction, i.e., a depth direction in FIG. 1, and apply light to the photosensitive drum 17A on a dot-unit basis by means of the light-emitting diodes. The photosensitive drum 17A may be subjected to exposure by the exposure section 19, thereby causing an electrostatic latent image to be formed on the surface of the photosensitive drum 17A. The transfer roller 21 may transfer, onto a transfer surface of the medium 9, the toner image formed by the image forming unit 17. The transfer roller 21 may be so disposed as to be opposed to the photosensitive drum 17A of the image forming unit 17 with the conveyance path 10 interposed in between.

The fixing section 22 may apply heat and pressure on the medium 9 and thereby fix, to the medium 9, the toner image that has been transferred on the medium 9.

The medium sensor 23 may detect the medium 9 conveyed along the conveyance path 10. The conveying roller 24 may convey, along the conveyance path 10, the medium 9 having the fixed toner image. The medium sensor 25 may be disposed near the discharging slot 27. The medium sensor 25 may detect the medium 9 conveyed along the conveyance path 10. The discharging roller 26 may discharge the medium 9 from the discharging slot 27 to the discharging tray 28. The discharging slot 27 may allow the medium 9 conveyed along the conveyance path 10 to be discharged to the discharging tray 28. The discharging tray 28 may so receive the discharged medium 9 with the formed image that the medium 9 is placed on the discharging tray 28.

The operation panel 30 may display information such as an operating state of the image forming apparatus 1 and receive operation performed by a user.

Figure 2:
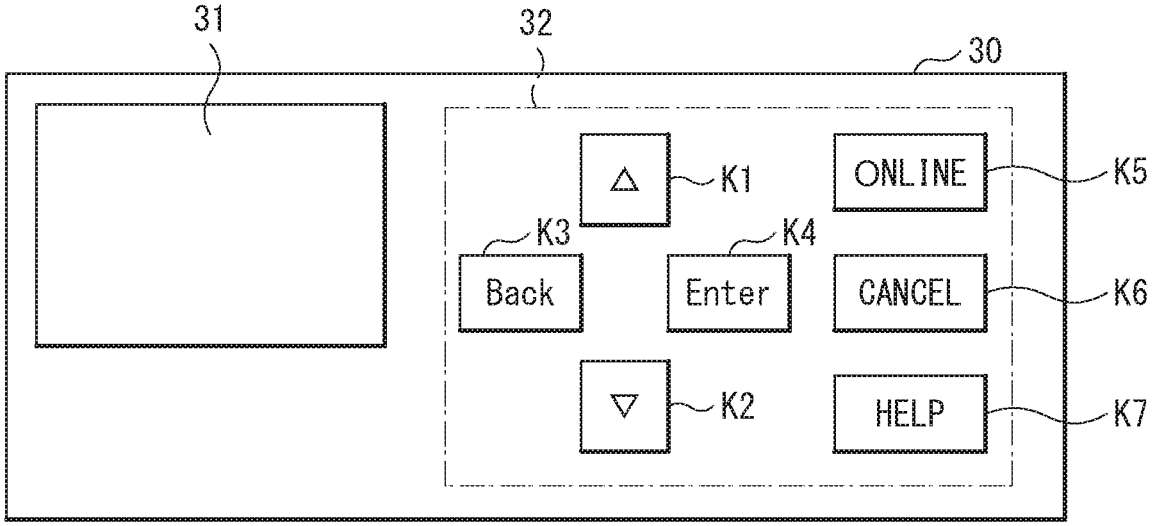
FIG. 2 is a diagram illustrating a configuration example of an operation panel according to a first example embodiment.
Figure 3:
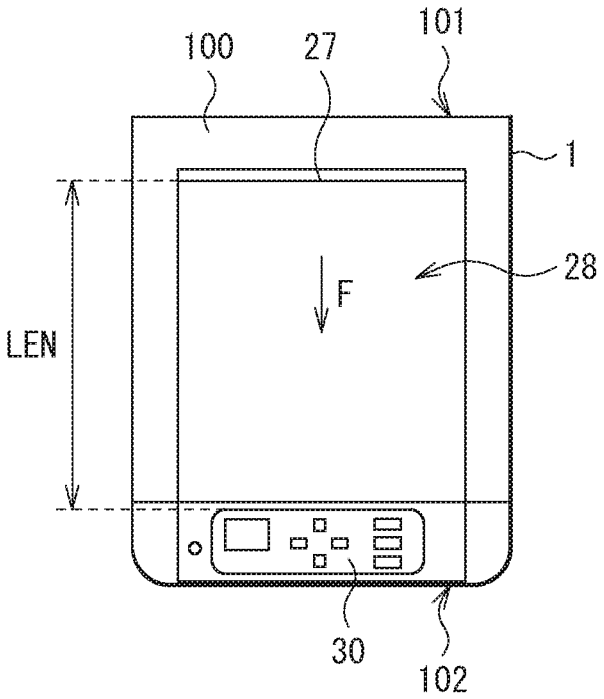
FIG. 3 is an explanatory diagram illustrating an example of a position to dispose an operation panel illustrated in FIG. 2.

FIG. 2 illustrates a configuration example of the operation panel 30. FIG. 3 illustrates an example of disposing the operation panel 30 on the image forming apparatus 1. As illustrated in FIGS. 1 and 3, the operation panel 30 may be disposed downstream of the discharging slot 27 in a discharging direction F. The discharging direction F may be a direction in which the medium 9 is discharged from the discharging slot 27. In one specific but non-limiting example, the discharging slot 27, the discharging tray 28, and the operation panel 30 may be disposed in this order between an end 101 of the housing 100 and an end 102 of the housing 100. The end 102 may be opposed to the end 101. The operation panel 30 may overlap the discharging slot 27 in a direction intersecting a direction from the end 101 toward the end 102. The direction from the end 101 toward the end 102 may correspond to the discharging direction F, and the direction intersecting the direction from the end 101 toward the end 102 may correspond to a lateral direction in FIG. 3. Note that a way of disposing the operation panel 30 is not limited thereto. In another example, a portion or all of the operation panel 30 may overlap the discharging slot 27 in the direction intersecting the direction from the end 101 toward the end 102. As illustrated in FIG. 2, the operation panel 30 may include a display section 31 and a touch key section 32.

The display section 31 may display the information such as the operating state of the image forming apparatus 1. The display section 31 may include, for example but not limited to, a liquid crystal display.

The touch key section 32 may receive operation performed by the user. The touch key section 32 may include a capacitive touch sensor. In this example, the touch key section 32 may include seven touch keys K. The seven touch keys K may include an "Up" key K1, a "Down" key K2, a "Back" key K3, an "Enter" key K4, an "ONLINE" key K5, a "CANCEL" key K6, and a "HELP" key K7. The "Up" key K1 may be operated by the user when the user moves a cursor displayed on the display section 31 upward, for example. The "Down" key K2 may be operated by the user when the user moves the cursor displayed on the display section 31 downward, for example. The "Back" key K3 may be operated by the user when the user return a menu to a previous menu, for example. The "Enter" key K4 may be operated by the user when the user selects a menu or determines a process, for example. The "ONLINE" key K5 may be operated by the user when the user causes the image forming apparatus 1 to be in an online state or an offline state, for example. The "CANCEL" key K6 may be operated by the user when the user cancels a process, for example. The "HELP" key K7 may be operated by the user when the user causes help information to be displayed on the display section 31, for example.

Figure 4:
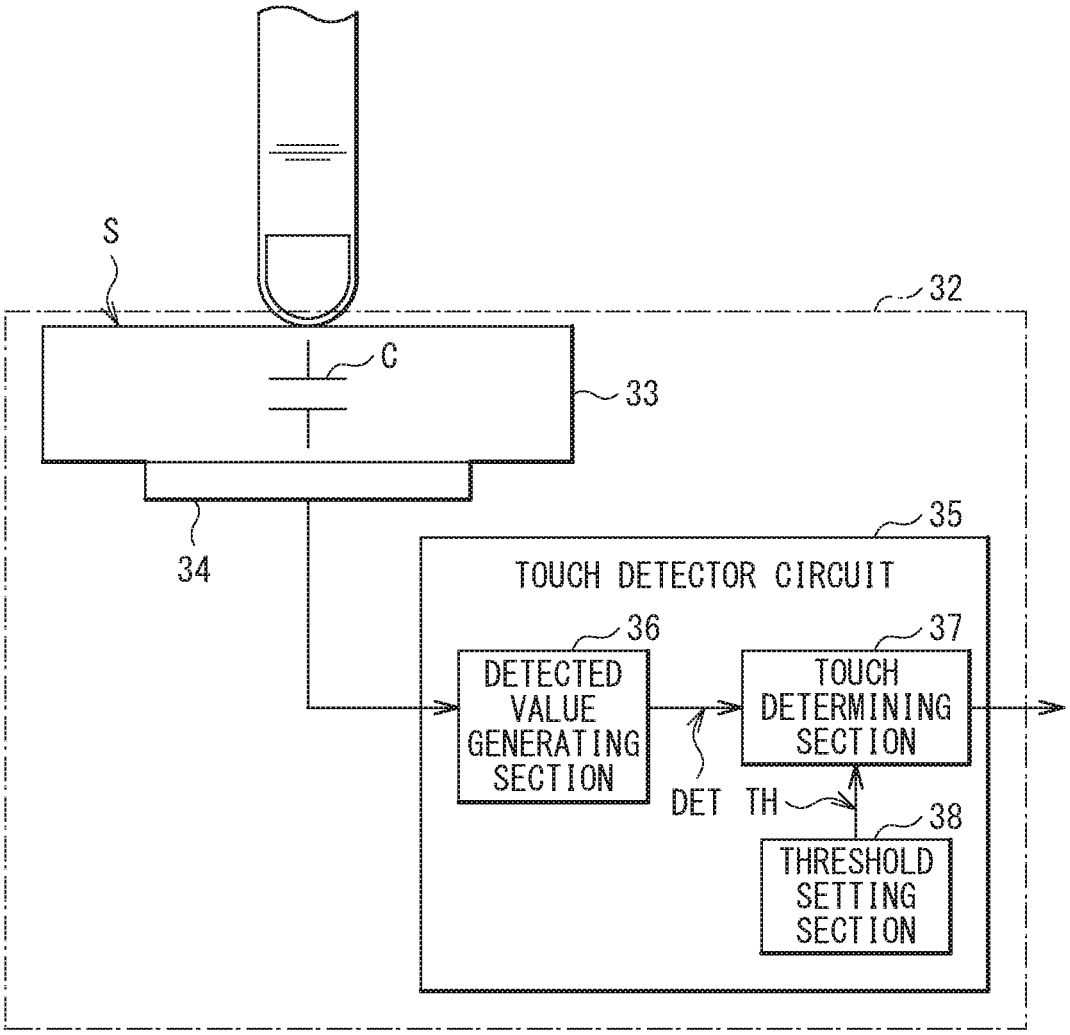
FIG. 4 is a diagram illustrating a configuration example of a touch key section illustrated in FIG. 2.

FIG. 4 illustrates a configuration example of the touch key section 32. The touch key section 32 may include a cover glass 33, an electrode sheet 34, and a touch detector circuit 35. The cover glass 33 may cover the electrode sheet 34. Note that, although glass may be used to cover the electrode sheet 34 in this example, a material used to cover the electrode sheet 34 is not limited to glass and may be acrylic resin, for example. The electrode sheet 34 may be provided on a surface opposite to an operation surface S of the touch key section 32. The touch detector circuit 35 may detect variation in capacitance C by means of the electrode sheet 34 and thereby detect the user's touch, for example. For example, when the user's finger approaches the operation surface S, a value of the capacitance detected by the electrode sheet 34 may increase. That is, a decrease in a distance from the user's finger to the electrode sheet 34 may cause the value of the capacitance C between the user's finger and the electrode sheet 34 to increase. This may cause the value of the capacitance C detected by means of the electrode sheet 34 to increase. The touch detector circuit 35 may monitor the value of the capacitance C, and detect a touch when the value of the capacitance C increases.

The touch detector circuit 35 may include a detected value generating section 36, a touch determining section 37, and a threshold setting section 38. The detected value generating section 36 may generate a detected value DET based on the capacitance C. In this example, the greater the value of the capacitance C is, the greater the detected value DET may be. The touch determining section 37 may compare the detected value DET with a threshold TH, and determine that the touch key K is in an ON state in a case where the detected value DET is greater than the threshold TH. The threshold setting section 38 may set the threshold TH on the basis of an instruction provided by an operation panel controller 50 which will be described later. This may allow detection sensitivity of the touch key section 32 to be varied.

[Control System in Image Forming Apparatus 1]

Figure 5:
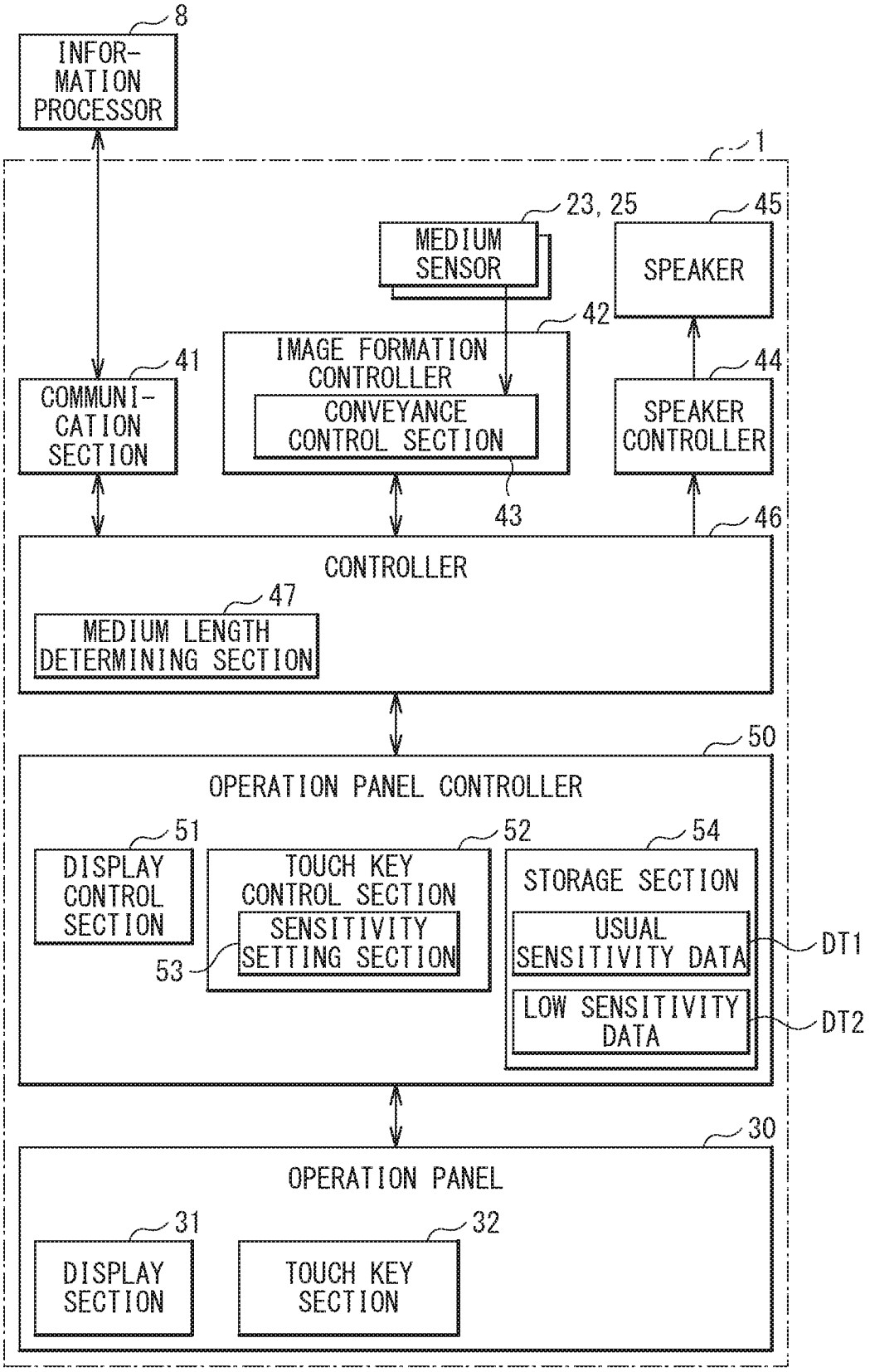
FIG. 5 is a block diagram illustrating a configuration example of an image forming apparatus according to the first example embodiment.

FIG. 5 illustrates an example of a control system in the image forming apparatus 1. The image forming apparatus 1 may include a communication section 41, an image formation controller 42, a speaker controller 44, a speaker 45, the operation panel controller 50, and a controller 46.

The communication section 41 may perform communication with another unit or device by means of a universal serial bus (USB) or a local area network (LAN), for example. The communication section 41 may receive print data DP transmitted from an information processor 8 such as a personal computer, for example. The print data DP may include image data, information related to a medium size of the medium 9, i.e., size information INF, information related to a medium thickness of the medium 9, and information related to a kind of the medium 9, for example. The size information INF may include information related to a medium length of the medium 9.

The image formation controller 42 may control image formation operation performed by the image forming apparatus 1 on the medium 9. For example, the image formation controller 42 may control operation including, without limitation, conveying operation of the medium 9 performed by various rollers, toner image formation operation performed by the image forming unit 17 and the exposure section 19, and fixing operation of the toner image on the medium 9 performed by the fixing section 22. The image formation controller 42 may include a conveyance control section 43. The conveyance control section 43 may control, on the basis of a result of detection performed by each of the medium sensor 23 and the medium sensor 25, operation of conveying the medium 9 along the conveyance path 10.

The speaker controller 44 may control operation of the speaker 45. The speaker 45 may output various sounds and thereby notify the user of a state of the image forming apparatus 1, for example. For example, the speaker controller 44 may control the speaker 45 to output an effective-state sound or an ineffective-state sound when the touch key K of the touch key section 32 is turned on. The effective-state sound may indicate an effective state, and the ineffective-state sound may indicate an ineffective state. In one specific but non-limiting example, the speaker controller 44 may control the speaker 45 to output the effective-state sound when an effective touch key K of the two or more touch keys K in the touch key section 32 is turned on, and the speaker controller 44 may control the speaker 45 to output the ineffective-state sound when an ineffective touch key K of the two or more touch keys K in the touch key section 32 is turned on.

The operation panel controller 50 may control operation of the operation panel 30. The operation panel controller 50 may include a display control section 51, a touch key control section 52, and a storage section 54.

The display control section 51 may control operation of the display section 31 of the operation panel 30. The display section 31 may display, for example but not limited to, a menu screen or an image indicating the operating state of the image forming apparatus 1 on the basis of an instruction given from the display control section 51.

The touch key control section 52 may control operation of the touch key section 32 of the operation panel 30. The touch key control section 52 may include a sensitivity setting section 53. The sensitivity setting section 53 may control operation of the threshold setting section 38 of the touch key section 32 and thereby set the detection sensitivity of the touch key section 32. The sensitivity setting section 53 may have two operation modes, i.e., a usual sensitivity mode M1 and a low sensitivity mode M2. The usual sensitivity mode M1 may be set, for example, in a case where the image forming apparatus 1 is in a standby state. In the usual sensitivity mode M1, the sensitivity setting section 53 may set the detection sensitivity of the touch key section 32 to usual sensitivity. The low sensitivity mode M2 may be set in order to prevent erroneous detection due to electrically-charged medium 9 as will be described later. In the low sensitivity mode M2, the sensitivity setting section 53 may set the detection sensitivity of the touch key section 32 to low sensitivity. The detection sensitivity of the touch key section 32 in the low sensitivity mode M2 may be so set that the touch key section 32 is to detect an intentional touch by the user but not to detect a contact with the electrically-charged medium 9, for example, as will be described later. Thus, in the low sensitivity mode M2, detection operation is limited by decreasing the detection sensitivity. In the usual sensitivity mode M1, the sensitivity setting section 53 may set the detection sensitivity of the touch key section 32 on the basis of usual sensitivity data DT1 stored in the storage section 54. In the low sensitivity mode M2, the sensitivity setting section 53 may set the detection sensitivity of the touch key section 32 on the basis of low sensitivity data DT2 stored in the storage section 54. The usual sensitivity data DT1 and the low sensitivity data DT2 will be described later. The threshold setting section 38 of the touch key section 32 may so set the threshold TH that the threshold TH in the low sensitivity mode M2 is higher than the threshold TH in the usual sensitivity mode M1, on the basis of an instruction given from the sensitivity setting section 53.

The storage section 54 may include, for example but not limited to, a non-volatile memory. The storage section 54 may hold the usual sensitivity data DT1 and the low sensitivity data DT2. The usual sensitivity data DT1 may be information related to a setting value of the detection sensitivity of the touch key section 32 in the usual sensitivity mode M1. For example, the usual sensitivity data DT1 may include information related to two or more thresholds TH corresponding to the respective touch keys K in the touch key section 32. The low sensitivity data DT2 may be information related to a setting value of the detection sensitivity of the touch key section 32 in the low sensitivity mode M2. For example, the low sensitivity data DT2 may include information related to two or more thresholds TH corresponding to the respective touch keys K in the touch key section 32.

The controller 46 may control general operation of the image forming apparatus 1. The controller 46 may include a medium length determining section 47. The medium length determining section 47 may determine whether the medium length is longer than a predetermined length LEN on the basis of the size information INF, which is the information related to the medium size of the medium 9, included in the print data DP received by the communication section 41. As illustrated in FIG. 3. the predetermined length LEN may be set to a length from the discharging slot 27 to an uppermost portion of the operation panel 30 in the discharging direction F. Note, however, that the predetermined length LEN is not limited thereto. In one example, the predetermined length LEN may be shorter than the length from the discharging slot 27 to the uppermost portion of the operation panel 30 by a length corresponding to a margin in the discharging direction F. The length corresponding to the margin may be set taking into consideration an amount by which the medium 9 moves in the discharging direction F when the discharged medium 9 falls on a bottom of the discharging tray 28. The sensitivity setting section 53 of the operation panel controller 50 may set the detection sensitivity of the touch key section 32 on the basis of a result of determination made by the medium length determining section 47, as will be described later.

With this configuration, in the image forming apparatus 1, the operation mode may be set to the low sensitivity mode M2 in a case where the print data DP transmitted from the information processor 8 is received and the medium length of the medium 9 is longer than the predetermined length LEN. In the low sensitivity mode M2, the detection sensitivity of the touch key section 32 may be set to low sensitivity. This allows for a reduction in a possibility that the touch key section 32 performs erroneous detection even in a case where the discharged medium 9 reaches the operation panel 30 and comes in contact with the touch key section 32.

The image forming unit 17, the exposure section 19, the transfer roller 21, and the fixing section 22 may correspond to a "processor" in one specific but non-limiting embodiment of the technology. The discharging slot 27 may correspond to a "discharging section" in one specific but non-limiting embodiment of the technology. The discharging tray 28 may correspond to a "placing section" in one specific but non-limiting embodiment of the technology. The operation panel 30 may correspond to an "operation section" in one specific but non-limiting embodiment of the technology. The operation panel controller 50 and the controller 46 may correspond to an "operation controller" in one specific but non-limiting embodiment of the technology. The usual sensitivity mode M1 may correspond to a "detection mode" in one specific but non-limiting embodiment of the technology. The low sensitivity mode M2 may correspond to a "limiting mode" in one specific but non-limiting embodiment of the technology.

[Example Operation and Example Workings]

A description is given next of example operation and example workings of the image forming apparatus 1 according to the first example embodiment.

[Outline of Overall Operation]

Referring to FIGS. 1 and 5, an outline of overall operation of the image forming apparatus 1 is described first. When the communication section 41 receives the print data DP, the controller 46 may control operation of the image forming apparatus 1 on the basis of the received print data DP. The image formation controller 42 may control operation including, without limitation, the conveying operation of the medium 9 performed by various rollers, the toner image formation operation performed by the image forming unit 17 and the exposure section 19, and the fixing operation of the toner image on the medium 9 performed by the fixing section 22. This may cause the medium 9 picked up from the medium cassette 11 to be conveyed along the conveyance path 10, cause the image forming unit 17 to generate the toner image, cause the generated toner image to be transferred onto the medium 9, and cause the fixing section 22 to fix, to the medium 9, the toner image transferred on the medium 9. Further, the medium 9 with the fixed toner image may be conveyed along the conveyance path 10 and the conveyed medium 9 may be discharged from the discharging slot 27 to the discharging tray 28.

The sensitivity setting section 53 of the touch key control section 52 may set the operation mode to the usual sensitivity mode M1, for example, when the image forming apparatus 1 is in the standby state. The medium length determining section 47 of the controller 46 may determine whether the medium length is longer than the predetermined length LEN on the basis of the size information INF, i.e., the information related to the medium size of the medium 9 included in the print data DP. In a case where the medium length is longer than the predetermined length LEN, the sensitivity setting section 53 of the touch key control section 52 may set the operation mode to the low sensitivity mode M2. In the low sensitivity mode M2, the detection sensitivity of the touch key section 32 may be set to low sensitivity. In a case where the touch key section 32 detects the user's touch in the low sensitivity mode M2, the sensitivity setting section 53 of the touch key control section 52 may set the operation mode to the usual sensitivity mode M1.

[Detailed Operation]

Figure 6A:
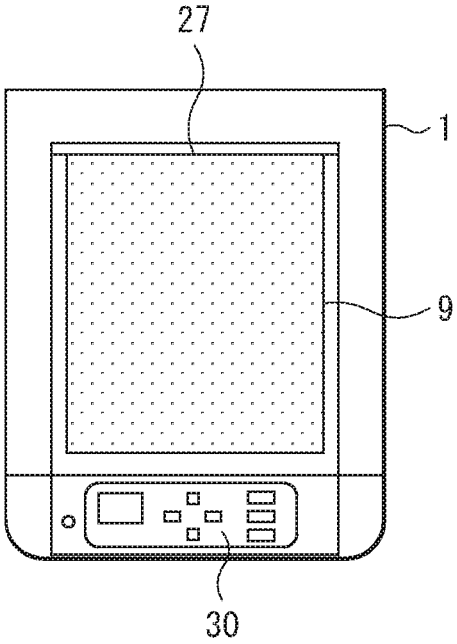
FIGS. 6A and 6B are each an explanatory diagram illustrating an example of a position of a medium discharged from an image forming apparatus illustrated in FIG. 1.
Figure 6B:
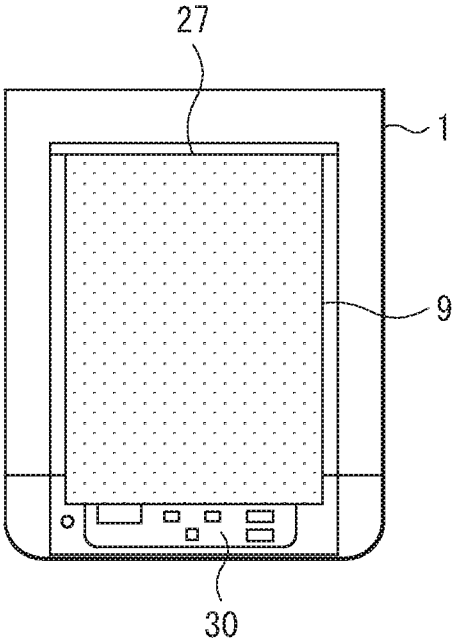

FIGS. 6A and 6B each illustrate an example of discharging operation of the medium 9 in the image forming apparatus 1. FIG. 6A illustrates an example case where the medium length of the medium 9 is shorter than the predetermined length LEN. FIG. 6B illustrates an example case where the medium length of the medium 9 is longer than the predetermined length LEN.

As illustrated in FIG. 6A, in the case where the medium length of the medium 9 is longer than the predetermined length LEN, the discharged medium 9 may not reach the operation panel 30. As illustrated in FIG. 6B, in the case where the medium length of the medium 9 is shorter than the predetermined length LEN, the discharged medium 9 may reach the operation panel 30, and in this example, the discharged medium 9 may cover a portion of the touch key section 32 of the operation panel 30. Upon forming an image on the medium 9, the image forming apparatus 1 may involve application of a high voltage to the medium 9 and the toner, for example. Accordingly, the medium 9 with the formed image can be electrically charged. When the medium 9 thus electrically charged comes into contact with the touch key section 32 including the capacitive touch sensor as illustrated in FIG. 6B, the touch key section 32 can erroneously detect that the touch key K is turned on.

In a case where erroneous detection at an ineffective touch key K of the two or more touch keys K in the touch key section 32 is performed, the speaker 45 may output the ineffective-state sound. In a case where erroneous detection at an effective touch key K of the two or more touch keys K in the touch key section 32 is performed, the speaker 45 may output the effective-state sound, and the image forming apparatus 1 may perform a process based on the touch key K at which the erroneous detection is performed. For example, in a case where the image forming apparatus 1 is in the standby state and erroneous detection at the "Up" key K1 or the "Down" key K2 is performed, the speaker 45 may output the effective-state sound and the display section 31 may display the menu screen. For example, in a case where the image forming apparatus 1 is performing the image formation operation or the image forming apparatus 1 is in the standby state and erroneous detection at the "Back" key K3 or the "Enter" key K4 is performed, the speaker 45 may output the ineffective-state sound. In a case where erroneous detection at the "ONLINE" key K5 is performed, the speaker 45 may output the effective-state sound and the image forming apparatus 1 may be brought into an offline state, making it unable to perform communication with the information processor 8. In a case where the image forming apparatus 1 is performing the image formation operation and erroneous detection at the "CANCEL" key K6 is performed, the speaker 45 may output the effective-state sound and the display section 31 may display a job cancel confirmation screen. In a case where the image forming apparatus 1 is performing the image formation operation and erroneous detection at the "HELP" key K7 is performed, the speaker 45 may output the ineffective-state sound. In a case where the image forming apparatus 1 is in the standby state and the erroneous detection at the "HELP" key K7 is performed, the speaker 45 may output the effective-state sound and the display section 31 may display a help screen. In a case where erroneous detection is performed successively two or more times, a change in setting or cancel of a job which is not intended by the user can be made. As described above, the image forming apparatus 1 may involve a possibility that various kinds of erroneous operation are performed in a case where the touch key section 32 performs the erroneous detection.

To address this, in the image forming apparatus 1, the sensitivity setting section 53 of the touch key control section 52 may set the operation mode to the low sensitivity mode M2 in the case where the medium length is longer than the predetermined length LEN. In the low sensitivity mode M2, the detection sensitivity of the touch key section 32 may be set to low sensitivity. This allows for reduction in the possibility that the touch key section 32 performs erroneous detection due to the electrically-charged medium 9 in the image forming apparatus 1. As a result, it is possible to reduce the possibility that erroneous operation based on the erroneous detection is performed in the image forming apparatus 1.

Figure 7:
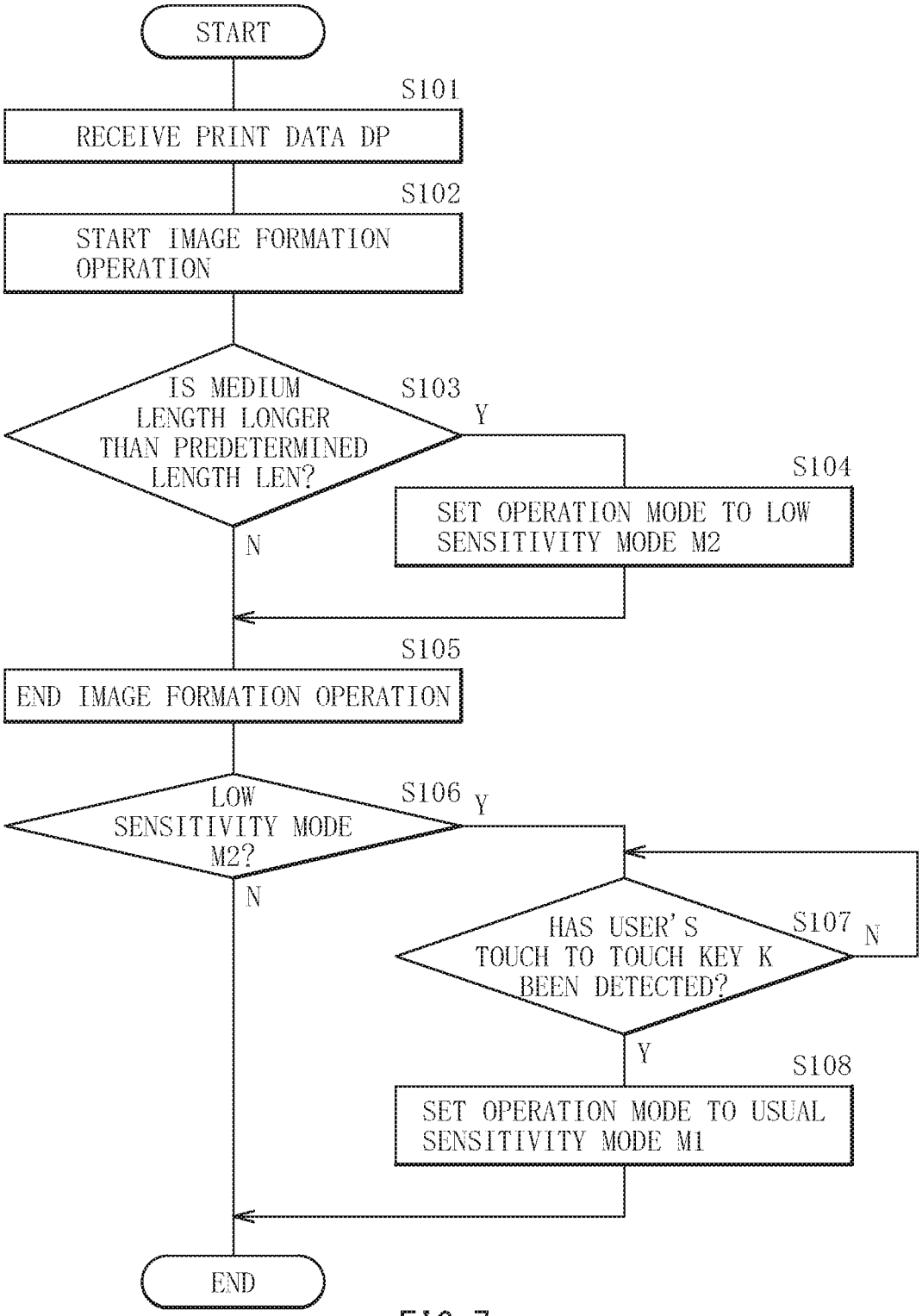
FIG. 7 is a flowchart illustrating an operation example of an image forming apparatus illustrated in FIG. 5.

FIG. 7 illustrates an operation example of the image forming apparatus 1. The image forming apparatus 1 may set the operation mode to the usual sensitivity mode M1, for example, in a case where the image forming apparatus 1 is in the standby state. Upon receiving the print data DP, the image forming apparatus 1 may determine whether the medium length is longer than the predetermined length LEN on the basis of the size information INF included in the received print data DP. In a case where the medium length is longer than the predetermined length LEN, the image forming apparatus 1 may set the operation mode to the low sensitivity mode M2. Further, in a case where the touch key section 32 detects the user's touch in the low sensitivity mode M2, the image forming apparatus 1 may return the operation mode to the usual sensitivity mode M1. This operation is described below in detail.

First, the communication section 41 of the image forming apparatus 1 may receive the print data DP supplied from the information processor 8 (step S101). The image formation controller 42 may control the image formation operation of the image forming apparatus 1 on the basis of the received print data DP, and thereby cause the image forming apparatus 1 to start the image formation operation (step S102).

Thereafter, the medium length determining section 47 of the controller 46 may determine whether the medium length is longer than the predetermined length LEN on the basis of the size information INF, i.e., the information related to the medium size of the medium 9, included in the print data DP which the communication section 41 has received in step S101 (step S103).

In a case where the medium length is longer than the predetermined length LEN in step S103 ("Y" in step S103), the sensitivity setting section 53 of the operation panel controller 50 may set the operation mode to the low sensitivity mode M2 (step S104). The sensitivity setting section 53 may control the operation of the threshold setting section 38 of the touch key section 32 on the basis of the low sensitivity data DT2 stored in the storage section 54, and the threshold setting section 38 may set the threshold TH of the touch key section 32. The detection sensitivity of the touch key section 32 may be thereby set to low sensitivity. That is, in this case, the touch key section 32 can perform erroneous detection due to the electrically-charged medium 9 because the medium length is longer than the predetermined length LEN. Therefore, the detection sensitivity of the touch key section 32 may be set low. In the low sensitivity mode M2, the threshold setting section 38 may set the threshold TH to a value that allows for detection of the user's intentional touch and allows for preventing detection of a contact with the electrically-charged medium 9. For example, in a case where the detected value DET derived from the user's intentional touch is "150" and the detected value DET derived from the contact with the electrically-charged medium 9 is "80", the threshold setting section 38 may set the threshold TH to a vale that is greater than "80" and smaller than "150". This allows for reduction in the possibility that the touch key section 32 performs erroneous detection due to the electrically-charged medium 9.

In contrast, in a case where the medium length is shorter than the predetermined length LEN in step S103 ("N" in step S103), the process may be caused to proceed to step S105. That is, in this case, the possibility that the touch key section 32 performs erroneous detection due to the electrically-charged medium 9 is low because the medium length is shorter than the predetermined length LEN. Therefore, the operation mode may be kept to the usual sensitivity mode M1.

As a result of the image formation operation performed by the image forming apparatus 1, the medium 9 with the image formed may be discharged to the discharging tray 28. Further, the image forming apparatus 1 may end the image formation operation (step S105).

Thereafter, the sensitivity setting section 53 may confirm whether the operation mode is set to the low sensitivity mode M2 (step S106). In a case where the operation mode is set to the usual sensitivity mode M1 ("N" in step S106), the process may be brought to an end of the flow. In a case where the operation mode is set to the low sensitivity mode M2 ("Y" in step S106), the touch key control section 52 of the operation panel controller 50 may confirm whether the touch key section 32 has detected the user's touch to the touch key K in the touch key section 32 (step S107). Because the operation mode is set to the low sensitivity mode M2, the touch key section 32 may be able to detect the user's touch, for example, in a case where the user intentionally touches the touch key K strongly. In a case where the touch key section 32 has not detected the user's touch ("N" in step S107), the process in step S107 may be performed repeatedly until the touch key section 32 detects the user's touch. In a case where the touch key section 32 has detected the user's touch ("Y" in step S107), the sensitivity setting section 53 may set the operation mode to the usual sensitivity mode M1 (step S108). The sensitivity setting section 53 may control the operation of the threshold setting section 38 of the touch key section 32 on the basis of the usual sensitivity data DT1 stored in the storage section 54, and the threshold setting section 38 may set the threshold TH of the touch key section 32.

The process may be thereby brought to an end of the flow.

As described above, in the image forming apparatus 1, the detection operation of the touch key section 32 may be limited on the basis of the size information INF indicating the information related to the medium size of the medium 9. In this example, the sensitivity setting section 53 may set the operation mode to the low sensitivity mode M2 in a case where the medium length of the medium 9 is determined to be longer than the predetermined length LEN on the basis of the size information INF, and thereby set the detection sensitivity of the touch key section 32 to low sensitivity. This allows for reduction in the possibility that the touch key section 32 performs the erroneous detection due to the electrically-charged medium 9 in the image forming apparatus 1. As a result, it is possible to reduce the possibility that erroneous operation is performed in the image forming apparatus 1.

Moreover, in the image forming apparatus 1, in a case where the touch key section 32 detects the user's intentional touch in the low sensitivity mode M2, the operation mode may be set to the usual sensitivity mode M1. This allows the operation mode to be returned from the low sensitivity mode M2 to the usual sensitivity mode M1 as a result of the user's touch in the image forming apparatus 1. Accordingly, switching of the detection sensitivity is allowed at a timing when the user intentionally wants to perform operation. As a result, it is possible to improve user friendliness.

[Example Effects]

As described above, according to the first example embodiment, detection operation performed by a touch key section may be limited on the basis of size information indicating information related to a medium size of a medium. As a result, it is possible to reduce the possibility that erroneous operation is performed.

According to the first example embodiment, the operation mode may be set to a usual sensitivity mode in a case where the touch key section detects a user's intentional touch in a low sensitivity mode. As a result, it is possible to improve user friendliness.

[Modification 1-1]

Figure 8:
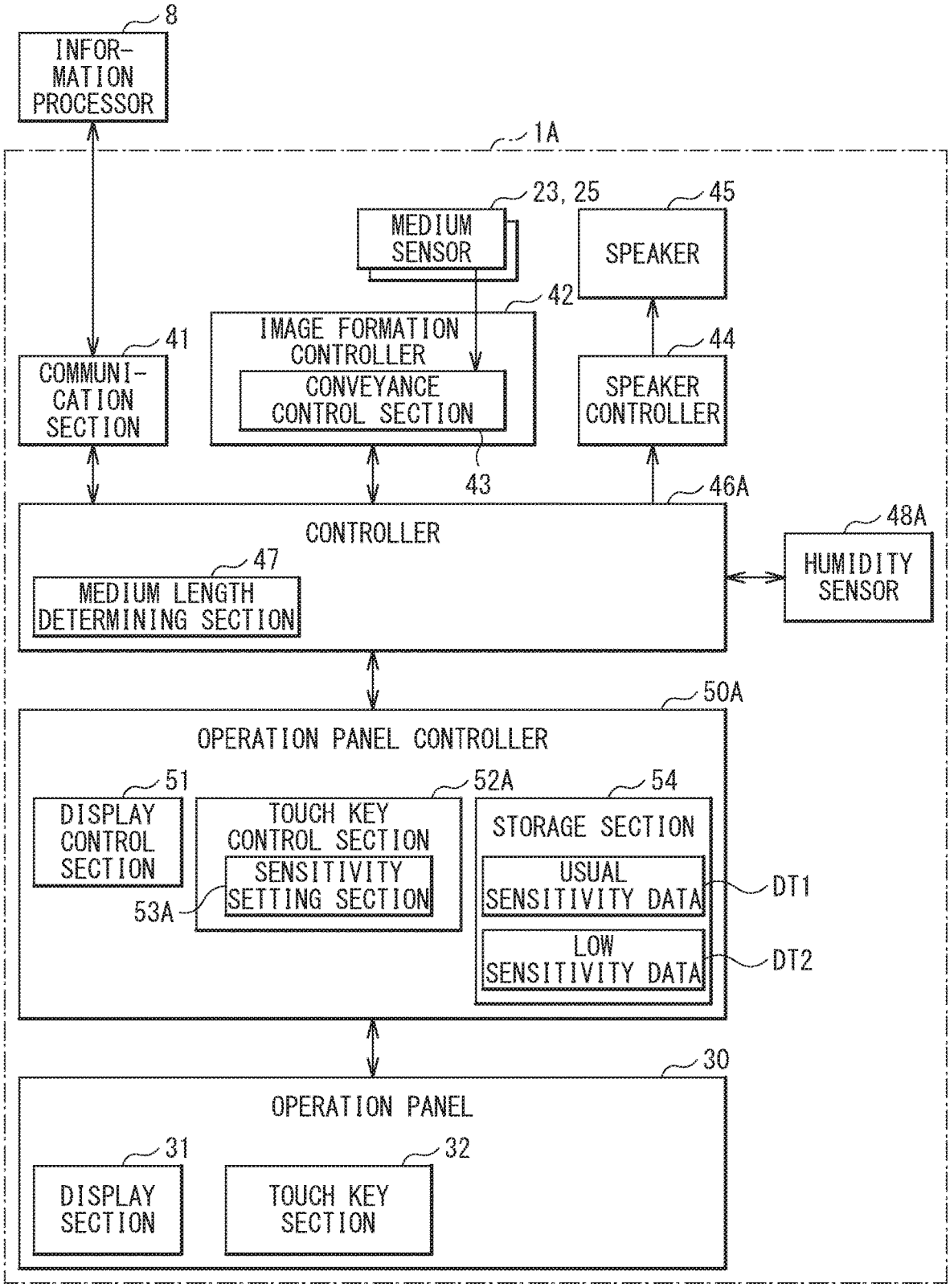
FIG. 8 is a block diagram illustrating a configuration example of an image forming apparatus according to a modification of the first example embodiment.

Although the detection sensitivity (the threshold TH) may be set on the basis of the size information INF according to the first example embodiment described above, this is non-limiting, and the detection sensitivity may be set on the basis of any other information in addition to the size information INF. In one example embodiment, the detection sensitivity may be set on the basis of environment humidity in addition to the size information INF, as in an image forming apparatus 1A illustrated in FIG. 8. The image forming apparatus 1A may include a humidity sensor 48A, a controller 46A, and an operation panel controller 50A. The humidity sensor 48A may detect environment humidity. The controller 46A may control overall operation of the image forming apparatus 1A. The operation panel controller 50A may include a touch key control section 52A. The touch key control section 52A may include a sensitivity setting section 53A. The sensitivity setting section 53A may set the detection sensitivity of the touch key section 32. The sensitivity setting section 53A may set the detection sensitivity of the touch key section 32 on the basis of the low sensitivity data DT2 stored in the storage section 54 and a result of the detection performed by the humidity sensor 48A, in the low sensitivity mode M2. For example, the sensitivity setting section 53A may correct the threshold TH included in the low sensitivity data DT2 on the basis of the environment humidity, and thereby set the detection sensitivity of the touch key section 32. The sensitivity setting section 53A may set the detection sensitivity to be higher in a case where the environment humidity is high, and may set the detection sensitivity to be lower in a case where the environment humidity is low, for example. That is, the high environment humidity makes it more difficult to cause the medium 9 to be electrically charged, therefore reducing the possibility that the touch key section 32 performs erroneous detection. Accordingly, the sensitivity setting section 53A may decrease the threshold TH and thereby increase the detection sensitivity in this case. In contrast, the low environment humidity makes it easier to cause the medium 9 to be electrically charged, therefore increasing the possibility that the touch key section 32 performs erroneous detection. Accordingly, the sensitivity setting section 53A may increase the threshold TH and thereby decrease the detection sensitivity in this case.

[Modification 1-2]

Although the threshold TH to be used in the low sensitivity mode M2 may be stored as the low sensitivity data DT2 in advance according to the first example embodiment, this is non-limiting. In one example embodiment, the low sensitivity data DT2 may be updated. This modification 1-2 is described below in detail.

Figure 9:
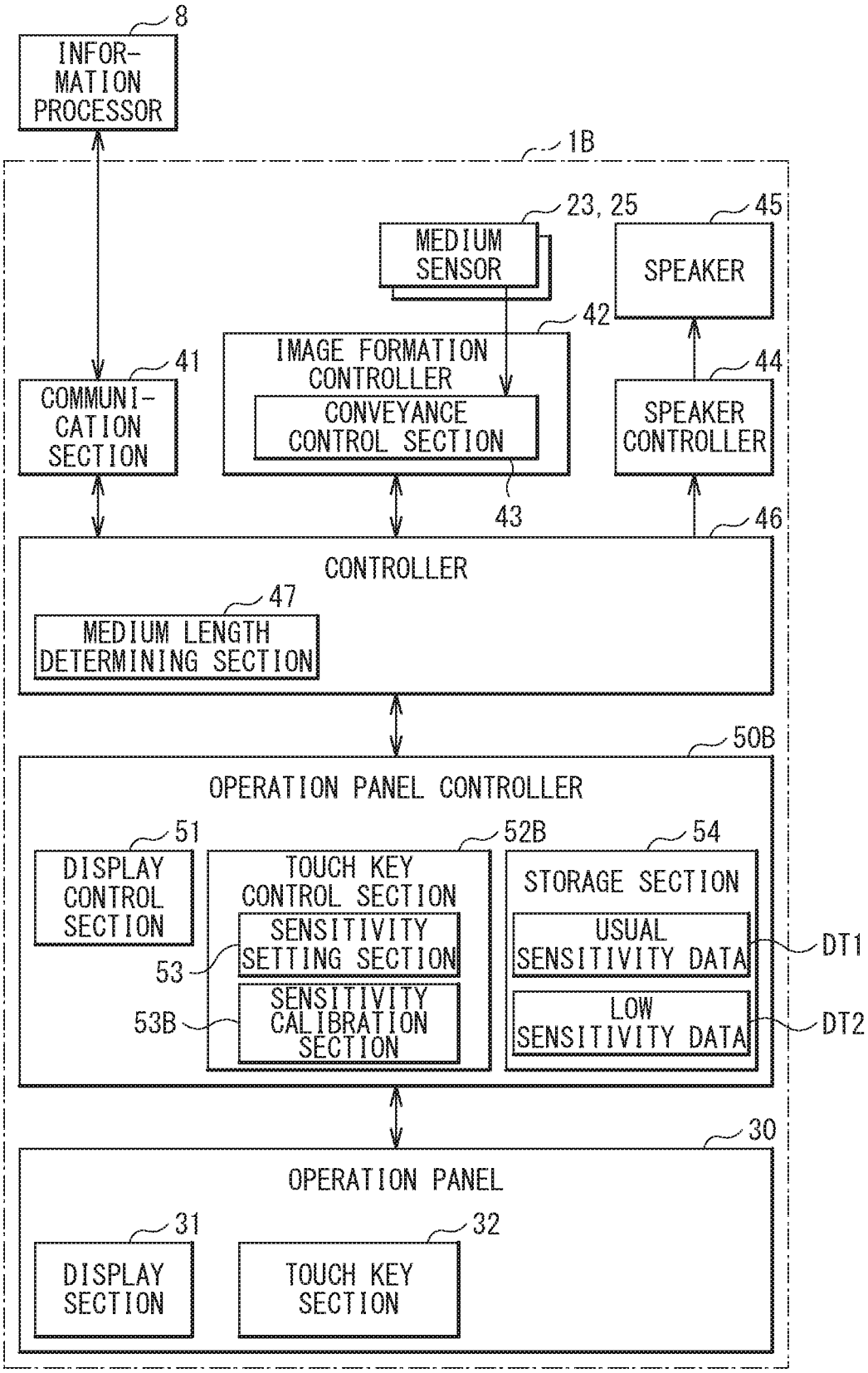
FIG. 9 is a block diagram illustrating a configuration example of an image forming apparatus according to another modification of the first example embodiment.

FIG. 9 illustrates a configuration example of an image forming apparatus 1B according to the modification 1-2. The image forming apparatus 1B may include an operation panel controller 50B. The operation panel controller 50B may include a touch key control section 52B. The touch key control section 52B may include a sensitivity calibration section 53B. The sensitivity calibration section 53B may calibrate the detection sensitivity in the low sensitivity mode M2, and update the low sensitivity data DT2 stored in the storage section 54 on the basis of a result of the calibration.

Figure 10:
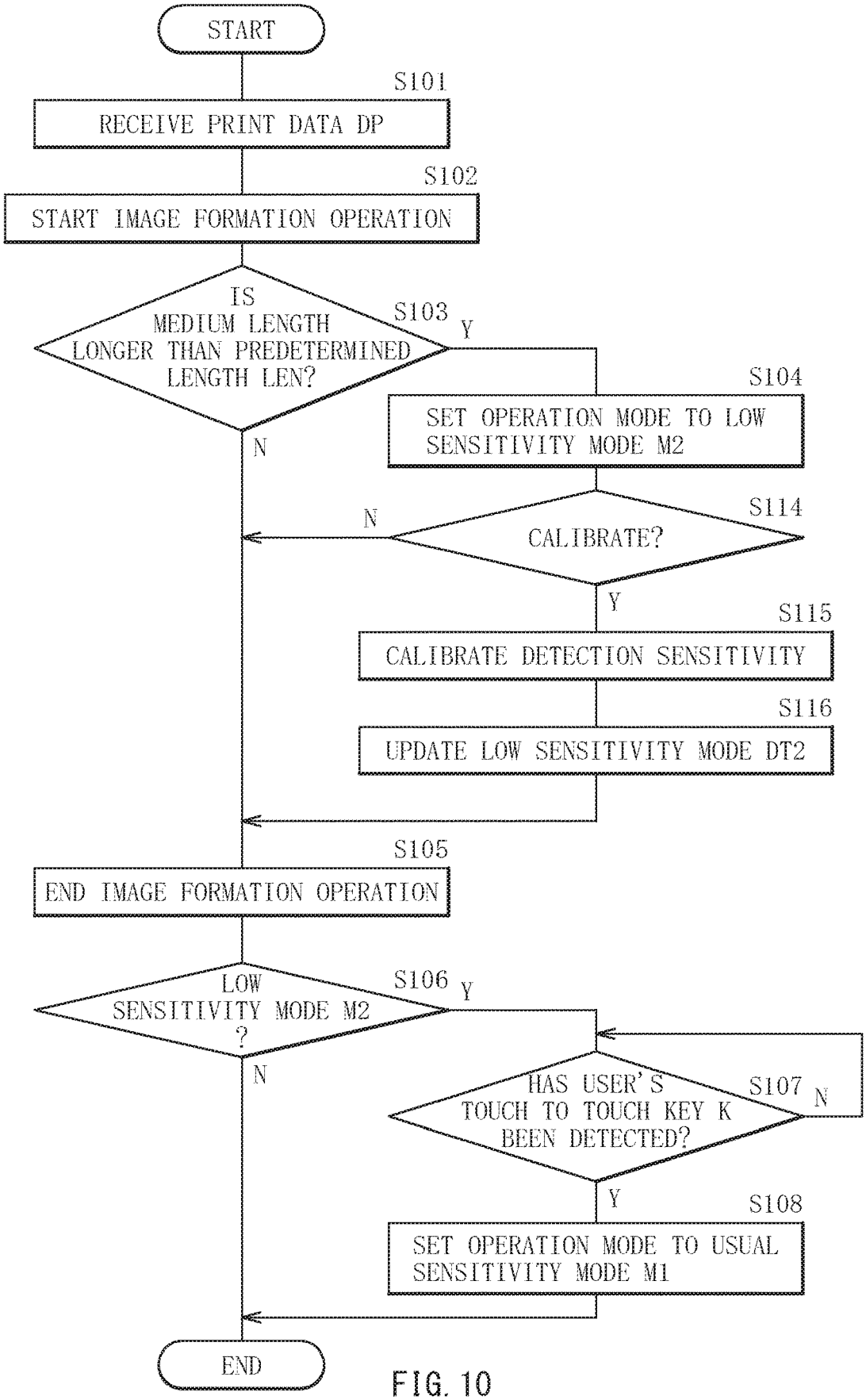
FIG. 10 is a flowchart illustrating an operation example of an image forming apparatus illustrated in FIG. 9.

FIG. 10 illustrates an operation example of the image forming apparatus 1B.

When the image forming apparatus 1B receives the print data DP (step S101), and starts the image formation operation (step S102), the medium length determining section 47 may determine whether the medium length is longer than the predetermined length LEN (step S103). In a case where the medium length is longer than the predetermined length LEN in step S103 ("Y" in step S103), the sensitivity setting section 53 of the operation panel controller 50B may set the operation mode to the low sensitivity mode M2 (step S104). The sensitivity setting section 53 may control the operation of the threshold setting section 38 of the touch key section 32 on the basis of the low sensitivity data DT2, and the threshold setting section 38 may set the threshold TH of the touch key section 32.

Thereafter, the sensitivity calibration section 53B of the operation panel controller 50B may confirm whether to calibrate the detection sensitivity (step S114). In one specific but non-limiting example, the sensitivity calibration section 53B may determine to calibrate the detection sensitivity in a case where the user operates the operation panel 30 and thereby instructs to calibrate the detection sensitivity in the low sensitivity mode M2, or in a case where the print data DP includes instruction information instructing to calibrate the detection sensitivity in the low sensitivity mode M2. In a case where the sensitivity calibration section 53B does not calibrate the detection sensitivity ("N" in step S114), the process may be caused to proceed to step S105.

In a case where the sensitivity calibration section 53B determines to calibrate the detection sensitivity ("Y" in step S114), the sensitivity calibration section 53B may calibrate the detection sensitivity (step S115). For example, when the medium 9 with the formed image is discharged to the discharging tray 28, the medium length of the medium 9 may cover a portion of the touch key section 32 because the medium length of the medium 9 is longer than the predetermined length LEN. The detected value generating section 36 of the touch key section 32 may generate the detected value DET at the time when the medium 9 comes into contact with the touch key section 32, for example. The sensitivity calibration section 53B may correct the threshold TH on the basis of the generated detected value DET. For example, the sensitivity calibration section 53B may set the threshold TH to a value slightly greater than the generated detected value DET. That is, the sensitivity calibration section 53B may set the threshold TH to the value slightly greater than the detected value DET in order to prevent the touch key section 32 from determining that the touch key K is turned on when the medium 9 comes into contact with the touch key section 32. Further, the sensitivity calibration section 53B may update the low sensitivity data DT2 with use of the set threshold TH (step S116). Further, the image forming apparatus 1B may end the image formation operation (step S105). Subsequent steps may be similar to those in the first example embodiment illustrated in FIG. 7.

In the image forming apparatus 1B, the detection sensitivity of the touch key section 32 in the low sensitivity mode M2 may be thereby varied. Accordingly, the threshold TH is allowed to be set in accordance with factors including, without limitation, an environment such as humidity and a kind of the medium 9. This allows for reduction in the possibility that the touch key section 32 performs erroneous detection. It is therefore possible to reduce the possibility that erroneous operation based on such erroneous detection is performed in the image forming apparatus 1B.

[Modification 1-3]

Although the operation mode may be set to the low sensitivity mode M2 after the medium length is determined to be longer than the predetermined length LEN according to the first example embodiment, this is non-limiting. In one example embodiment, a timing to set the operation mode to the low sensitivity mode M2 may be determined also on the basis of a conveyance situation of the medium 9. An image forming apparatus 1C according to this modification 1-3 is described below in detail.

The image forming apparatus 1C may include an image formation controller 42C and an operation panel controller 50C as with the image forming apparatus 1 according to the first example embodiment illustrated in FIG. 5. The image formation controller 42C may include a conveyance control section 43C. The conveyance control section 43C may detect a timing at which a leading edge of the discharged medium 9 reaches the operation panel 30. The operation panel controller 50C may include a touch key control section 52C. The touch key control section 52C may include a sensitivity setting section 53C. The sensitivity setting section 53C may set the detection sensitivity of the touch key section 32. The sensitivity setting section 53C may set the operation mode to the low sensitivity mode M2 at a timing instructed by the conveyance control section 43C.

The conveying roller 24 and the discharging roller 26 may correspond to a "conveying section" in one specific but non-limiting embodiment of the technology. The medium sensor 25 may correspond to a "medium sensor" in one specific but non-limiting embodiment of the technology.

Figure 11:
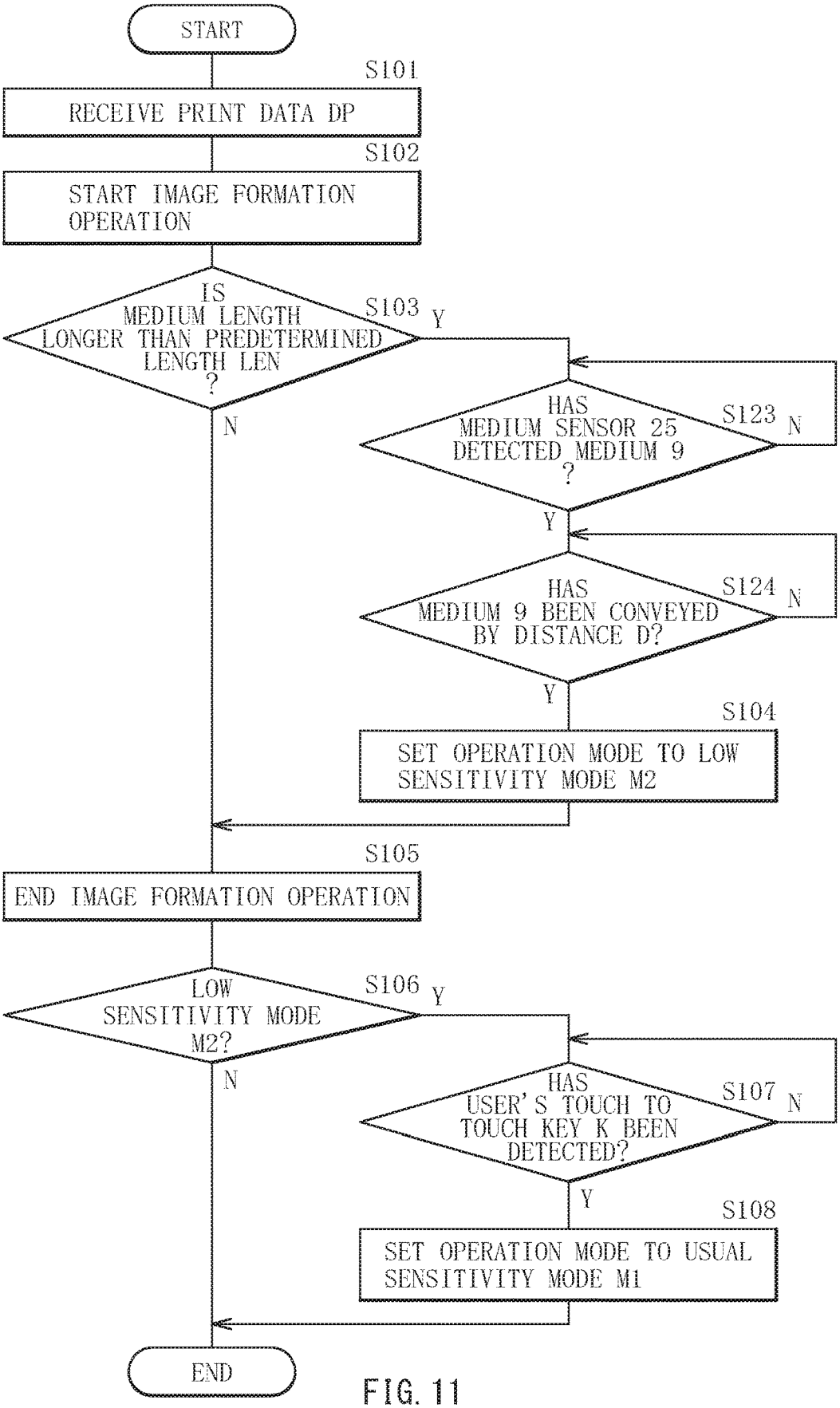
FIG. 11 is a flowchart illustrating an operation example of an image forming apparatus according to still another modification of the first example embodiment.

FIG. 11 illustrates an operation example of the image forming apparatus 1C.

When the image forming apparatus 1C receives the print data DP (step S101), and starts the image formation operation (step S102), the medium length determining section 47 may determine whether the medium length is longer than the predetermined length LEN (step S103). In a case where the medium length is longer than the predetermined length LEN ("Y" in step S103), the conveyance control section 43C of the image formation controller 42C may confirm whether the medium sensor 25 disposed near the discharging slot 27 has detected the leading edge of the medium 9 (step S123). In a case where the medium sensor 25 has not detected the leading edge of the medium 9 ("N" in step S123), the process in step S123 may be performed repeatedly until the medium sensor 25 detects the leading edge of the medium 9.

In a case where the medium sensor 25 has detected the leading edge of the medium 9 in step S123 ("Y" in step S123), the conveyance control section 43C may confirm whether the medium 9 has been conveyed by a predetermined distance D after the detection of the leading edge of the medium 9 (step S124). The predetermined distance D may be a distance from the medium sensor 25 to the end of the operation panel 30 via the discharging slot 27 and the discharging tray 28, for example. The conveyance control section 43C may divide the predetermined distance D by a conveyance speed of the medium 9 and thereby determine a time T. The conveyance control section 43C may confirm whether the time T has elapsed from the timing when the medium sensor 25 has detected the leading edge of the medium 9, and thereby confirm whether the medium 9 has been conveyed by the predetermined distance D. In one example embodiment, calculation of the time T may be conducted at an accuracy of about 1/100 seconds. In a case where the medium 9 has not been conveyed by the predetermined distance D yet ("N" in step S124), a process in step S124 may be performed repeatedly until the medium 9 is conveyed by the predetermined distance D.

In a case where the medium 9 has been conveyed by the predetermined distance D in step S124 ("Y" in step S124), the sensitivity setting section 53C of the touch key control section 52C may set the operation mode to the low sensitivity mode M2. Subsequent processes may be similar to those in the first example embodiment illustrated in FIG. 7.

In the image forming apparatus 1C, for example, in a case where the print data DP involves an instruction to form images on two or more recording media 9, the operation mode may be kept to the usual sensitivity mode M1 in a period up to a timing when the first one of the recording media 9 reaches the operation panel 30. Accordingly, in the image forming apparatus 1C, the term during which the operation mode is set to the usual sensitivity mode M1 may be increased, making it easier for the user to operate the "CANCEL" key K6 in a case where the user wants to cancel the job after the image formation operation is started, for example. As a result, it is possible to improve user friendliness in the image forming apparatus 1C.

[Modification 1-4]

Although the operation mode may be returned to the usual sensitivity mode M1 in a case where the touch key section 32 detects the user's intentional touch in the low sensitivity mode M2 according to the first example embodiment, this is non-limiting. In one example embodiment, the operation mode may be returned to the usual sensitivity mode M1 after a time allowing electric charging of the medium 9 to be resolved elapses after the image forming apparatus ends the image formation operation. The resolving of the electric charging of the medium 9 may be caused by releasing of the electric charge of the medium 9. An image forming apparatus 1D according to this modification 1-4 is described below in detail.

Figure 12:
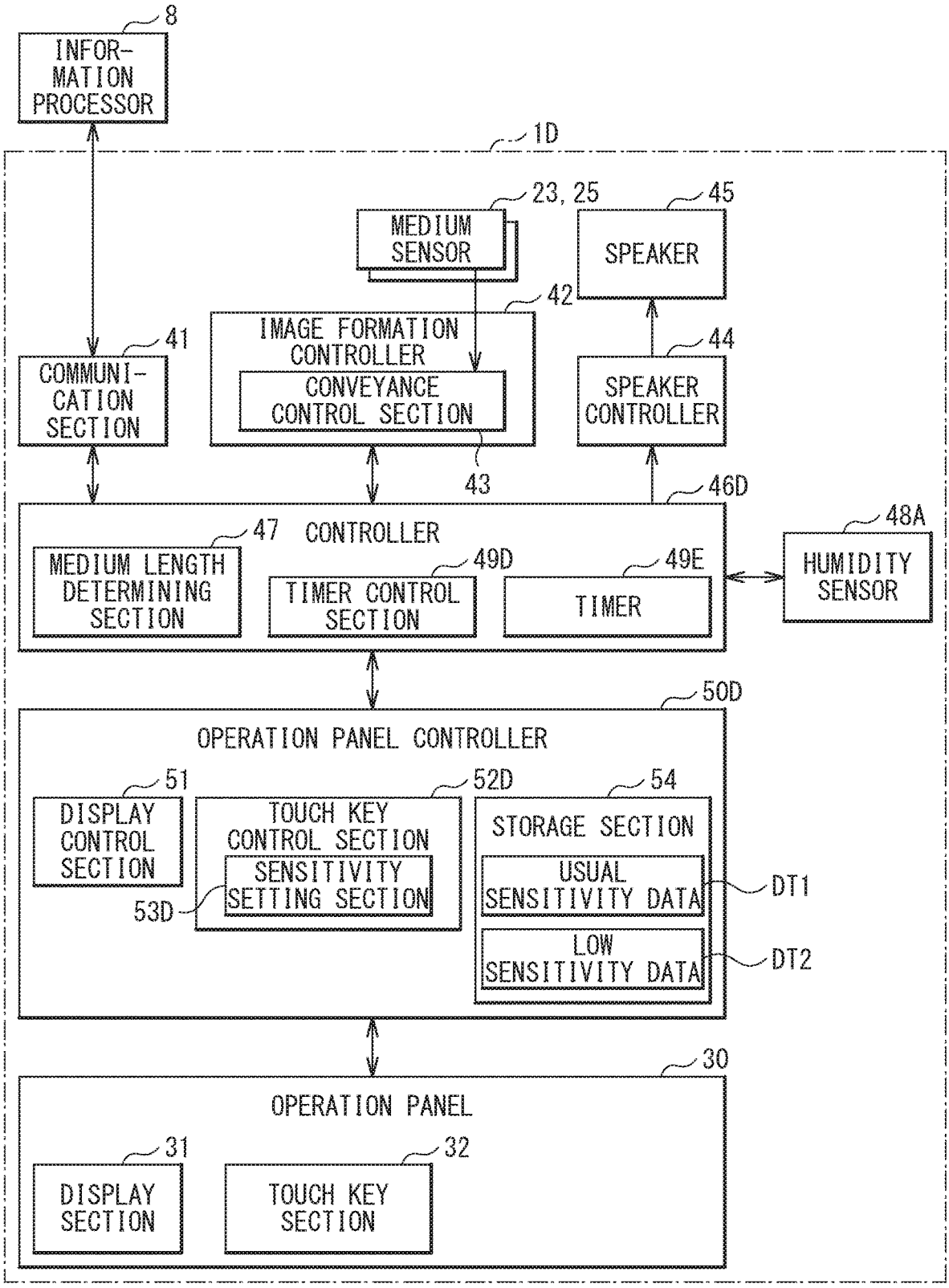
FIG. 12 is a block diagram illustrating a configuration example of an image forming apparatus according to still another modification of the first example embodiment.

FIG. 12 illustrates a configuration example of the image forming apparatus 1D. The image forming apparatus 1D may include the humidity sensor 48A, a controller 46D, and an operation panel controller 50D. The humidity sensor 48A may detect environment humidity. The controller 46D may control overall operation of the image forming apparatus 1D. The controller 46D may include a timer control section 49D and a timer 49E. The timer control section 49D may configure counting setting such as a counting time of the timer 49E on the basis of the information related to the kind of the medium 9 included in the print data DP and the environment humidity, for example. The timer 49E may perform counting operation for the set counting time on the basis of the counting setting instructed by the timer control section 49D. The operation panel controller 50D may include a touch key control section 52D. The touch key control section 52D may include a sensitivity setting section 53D. The sensitivity setting section 53D may set the detection sensitivity of the touch key section 32. The sensitivity setting section 53D may set the operation mode to the usual sensitivity mode M1 at a timing instructed by the controller 46D.

The humidity sensor 48A may correspond to an "environment sensor" in one specific but non-limiting embodiment of the technology. The timer 49E may correspond to a "timer" in one specific but non-limiting embodiment of the technology.

Figure 13:
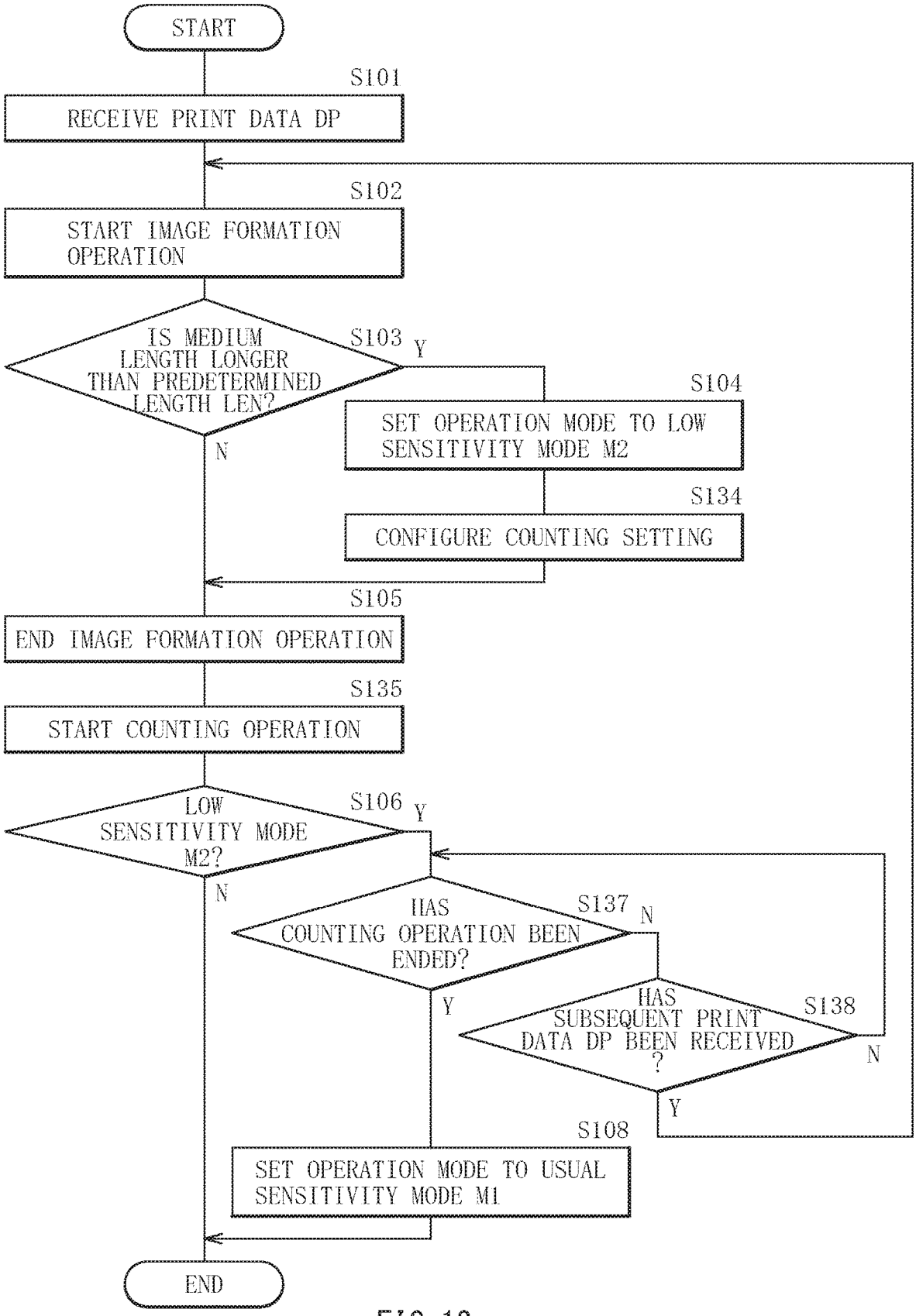
FIG. 13 is a flowchart illustrating an operation example of an image forming apparatus illustrated in FIG. 12.

FIG. 13 illustrates an operation example of the image forming apparatus 1D.

When the image forming apparatus 1D receives the print data DP (step S101), and starts the image formation operation (step S102), the medium length determining section 47 may determine whether the medium length is longer than the predetermined length LEN (step S103). In a case where the medium length is longer than the predetermined length LEN ("Y" in step S103), the sensitivity setting section 53D of the operation panel controller 50D may set the operation mode to the low sensitivity mode M2 (step S104).

Further, the timer control section 49D of the controller 46D may configure the counting setting of the timer 49E on the basis of the information related to the kind of the medium 9 included in the print data DP and the environment humidity (step S134). In one specific but non-limiting example, the timer control section 49D may so configure the counting setting that the counting time is longer in a case where the medium 9 is of a kind which involves difficulty in resolving electric charging. In another specific but non-limiting example, the timer control section 49D may so configure the counting setting that the counting time is longer in a case where the environment humidity is low and such environment humidity causes difficulty in resolving electric charging.

As a result of the image formation operation performed by the image forming apparatus 1D, the medium 9 with the formed image may be discharged to the discharging tray 28. Further. the image forming apparatus 1D may end the image formation operation (step S105). Further, the timer 49E of the controller 46D may start the counting operation for the set counting time (step S135).

Thereafter, the sensitivity setting section 53D may confirm whether the operation mode is set to the low sensitivity mode M2 (step S106). In a case where the operation mode is set to the low sensitivity mode M2 ("Y" in step S106), the controller 46D may confirm whether the timer 49E has ended the counting operation (step S137).

In a case where the timer 49E has not ended the counting operation yet in step S137 ("N" in step S137), the controller 46D may confirm whether the communication section 41 has received subsequent print data DP (step S138). In a case where the communication section 41 has not received the subsequent print data DP ("N" in step S138), the process may be caused to return to step S137. In a case where the communication section 41 has received the subsequent print data DP ("Y" in step S138), the process may be caused to return to step S102.

In a case where the timer 49E has ended the counting operation in step S137 ("Y" in step S137), the sensitivity setting section 53D may set the operation mode to the usual sensitivity mode M1. That is, it may be estimated that the electric charging of the medium 9 is almost resolved as the counting operation has been ended. When the electric charging of the medium 9 is almost resolved, the possibility that the touch key section 32 performs erroneous operation may be low. Accordingly, the sensitivity setting section 53D may set the operation mode to the usual sensitivity mode M1.

In the image forming apparatus 1D, the operation mode is thereby allowed to be returned to the usual sensitivity mode M1, for example, after the time allowing for resolving of the electric charging of the medium 9 elapses after the completion of the image formation operation. This allows the operation mode to be returned to the usual sensitivity mode M1 even without the user's intentional touch, unlike the first example embodiment. As a result, it is possible to improve user friendliness.

Moreover, the counting time of the timer 49E may be set on the basis of the information related to the kind of the medium 9 and the environment humidity, for example. Accordingly, it is possible to appropriately switch the detection sensitivity in accordance with the condition.

Although the counting time may be set on the basis of the environment humidity in this example, this is non-limiting. In one example embodiment, the counting time may be set on the basis of any other environment condition in addition to the environment humidity.

[Modification 1-5]

Figure 14:
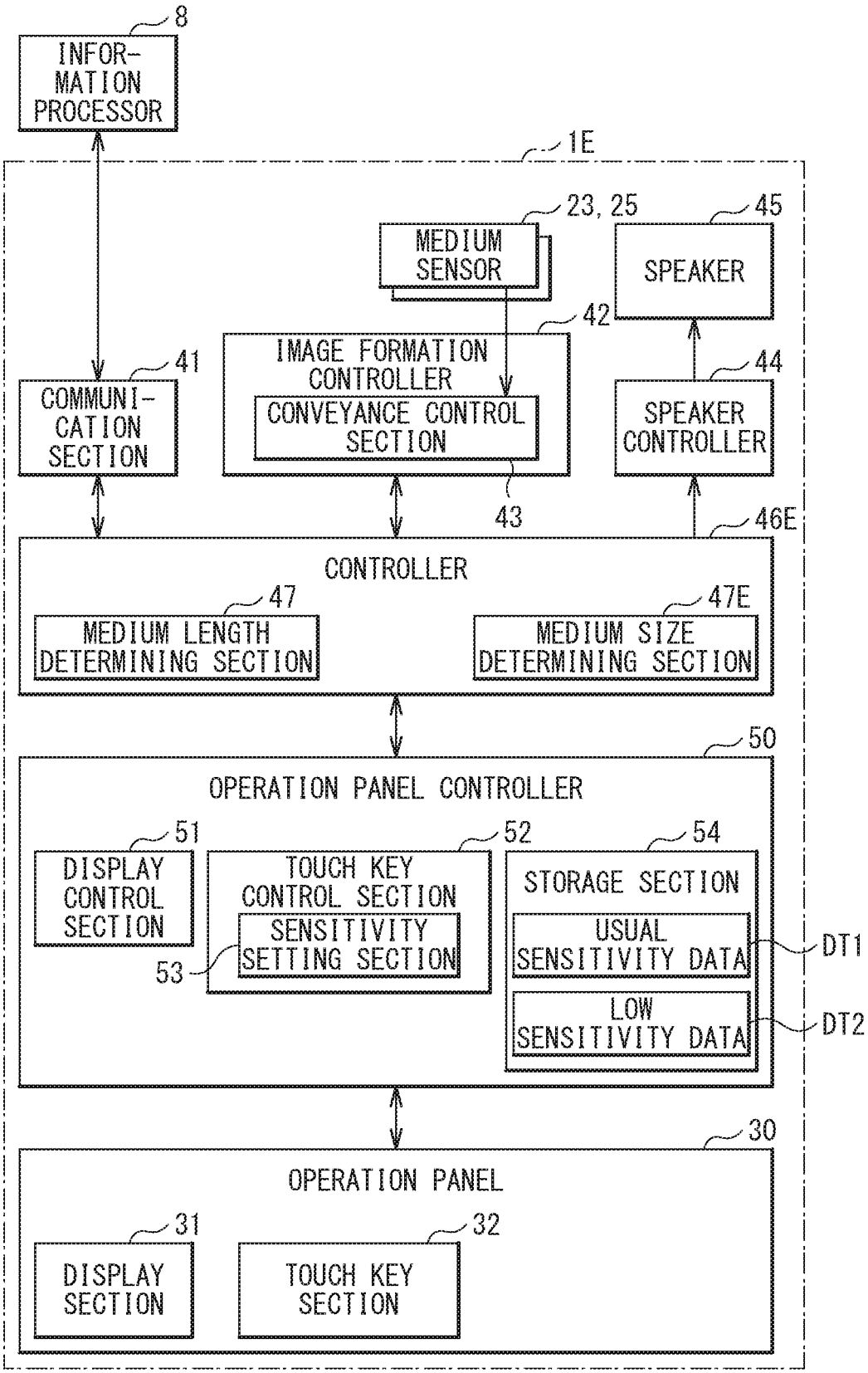
FIG. 14 is a block diagram illustrating a configuration example of an image forming apparatus according to still another modification of the first example embodiment.

Although the print data DP may include the size information INF, i.e., the information related to the medium size of the medium 9 according to the first example embodiment, this is non-limiting. In one example embodiment, the medium size of the medium 9 conveyed along the conveyance path 10 may be determined as in an image forming apparatus 1E illustrated in FIG. 14. The image forming apparatus 1E may include a controller 46E. The controller 46E may include a medium length determining section 47E. The medium length determining section 47E may determine the medium size of the medium 9 conveyed along the conveyance path 10 on the basis of a result of the detection performed by a sensor such as the medium sensor 23 or the medium sensor 25, for example. The medium length determining section 47 may determine the medium length on the basis of the medium size determined by the medium length determining section 47E.

[Other Modifications]

Combination of two or more of the modifications described above may be adopted.

2. Second Example Embodiment

A description is given next of an image forming apparatus 2 according to a second example embodiment. According to the second example embodiment, the detection operation of the touch key section may be limited by a method different from that according to the first example embodiment in a case where the medium length is longer than the predetermined length LEN. Note that components substantially the same as those in the image forming apparatus 1 according to the first example embodiment described above are denoted with the same referential numerals and a description thereof is omitted where appropriate.

Figure 15:
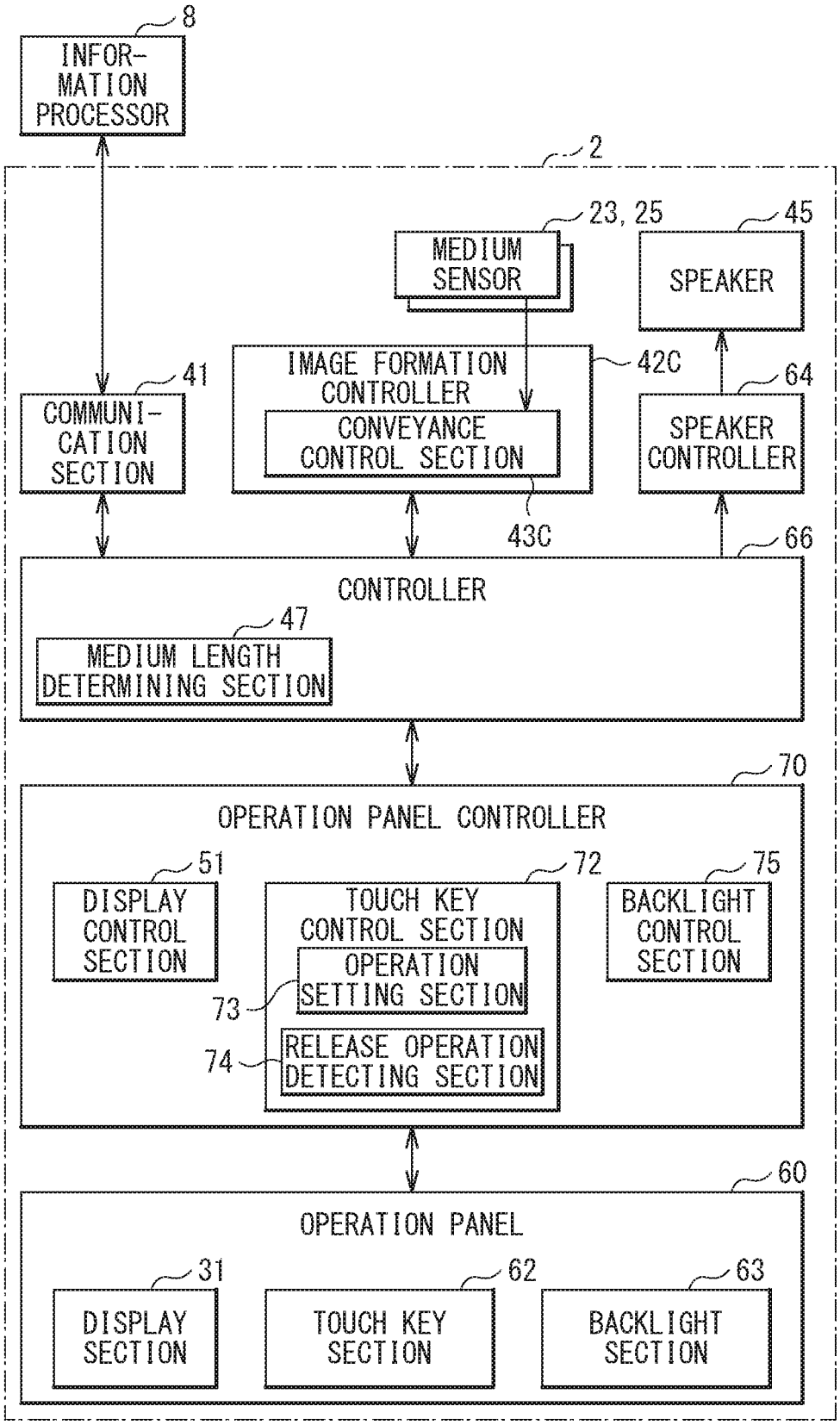
FIG. 15 is a block diagram illustrating a configuration example of an image forming apparatus according to a second example embodiment.

FIG. 15 illustrates a configuration example of the image forming apparatus 2. The image forming apparatus 2 may include an operation panel 60, an operation panel controller 70, a speaker controller 64, the image formation controller 42C, and a controller 66.

Figure 16:
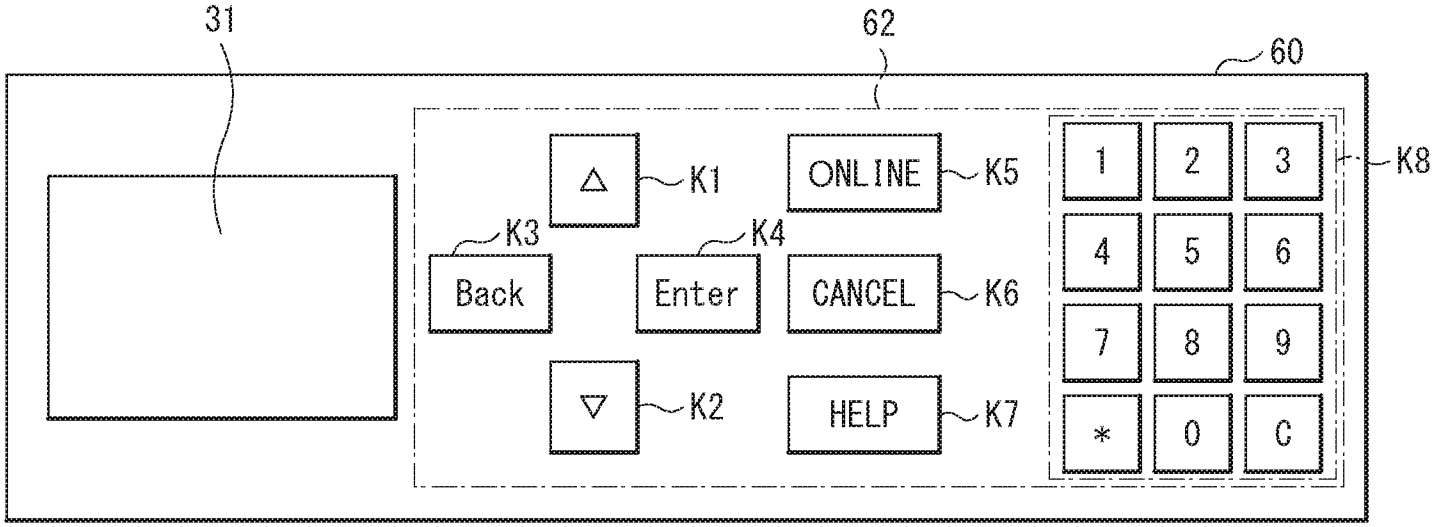
FIG. 16 is a diagram illustrating a configuration example of an operation panel of an image forming apparatus illustrated in FIG. 15.

FIG. 16 illustrates a configuration example of the operation panel 60. As illustrated in FIG. 15, the operation panel 60 may include the display section 31, a touch key section 62, and a backlight section 63.

The touch key section 62 may include the "Up" key K1, the "Down" key K2, the "Back" key K3, the "Enter" key K4, the "ONLINE" key K5, the "CANCEL" key K6, the "HELP" key K7, and a number key K8. The number key K8 may be operated by the user, for example, when the user inputs some numbers. In this example, the number key K8 may include twelve touch keys K.

The backlight section 63 may be disposed on back of an operation surface S of the touch key section 62, and may apply light to two or more touch keys K from their back. The backlight section 63 may include two or more light-emitting devices corresponding to the respective touch keys K, and may be thereby able to apply light independently to each of the touch keys K.

The operation panel controller 70 illustrated in FIG. 15 may include a touch key control section 72 and a backlight control section 75.

The touch key control section 72 may control operation of the touch key section 62 of the operation panel 60. The touch key control section 72 may include an operation setting section 73 and a release operation detecting section 74.

The operation setting section 73 may set a process based on a detection result from the touch key section 62 to be effective or ineffective. The operation setting section 73 may have two operation modes, i.e., an effective mode M11 and an ineffective mode M12. The effective mode M11 may be set, for example, in a case where the image forming apparatus 2 is in a standby state. In the effective mode M11, the process based on the detection result from the touch key section 62 may be made effective. The ineffective mode M12 may be set in order to prevent erroneous detection due to electrically-charged medium 9. In the ineffective mode M12, the process based on the detection result from the touch key section 62 may be made ineffective. That is, in the ineffective mode M12, the touch key section 62 may detect that the touch key K is in the ON state but the touch key control section 72 may make the process based on the detection result ineffective. In the ineffective mode M12, the detection operation may be thus limited by making the process based on the detection result from the touch key section 62 ineffective. In the ineffective mode M12, the touch key section 62 may be able to accept only a predetermined release operation OP that is directed to releasing the ineffective mode M12. The operation setting section 73 may change the operation mode from the ineffective mode M12 to the effective mode M11 in a case where the release operation detecting section 74 detects the release operation OP.

The release operation detecting section 74 may detect the release operation OP performed by the user in the ineffective mode M12. The release operation OP may be performed by the user to switch the operation mode from the ineffective mode M12 to the effective mode M11.

Figure 17:
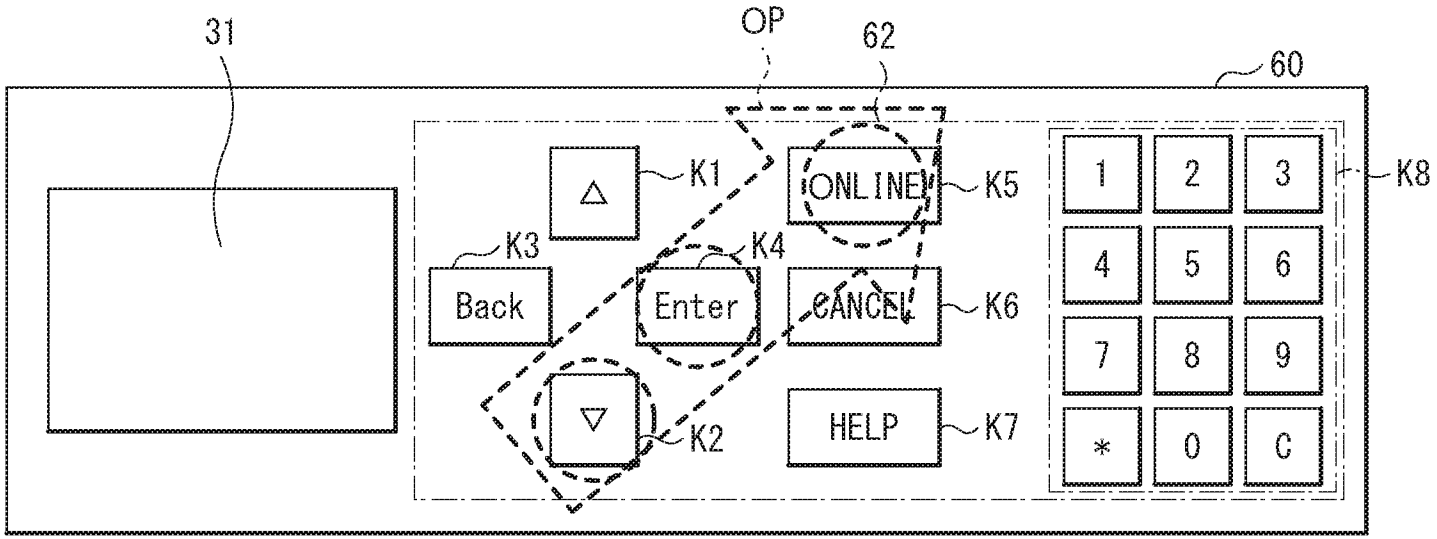
FIG. 17 is an explanatory diagram illustrating an example of a release operation of the image forming apparatus illustrated in FIG. 15.

FIG. 17 illustrates an example of the release operation OP. In this example, the release operation OP may involve turning on the "Down" key K2, the "Enter" key K4, and the "ONLINE" key K5 in this order. With such use of the three touch keys K adjacent to one another, the user may be allowed to turn on the three touch keys K in order by so-called swipe operation. In the ineffective mode M12, the operation setting section 73 may change the operation mode from the ineffective mode M12 to the effective mode M11 in a case where the release operation detecting section 74 detects the release operation OP. Accordingly, the user's release operation OP may appropriately cause the operation mode to be returned to the effective mode M11 in the image forming apparatus 2.

Figure 18:
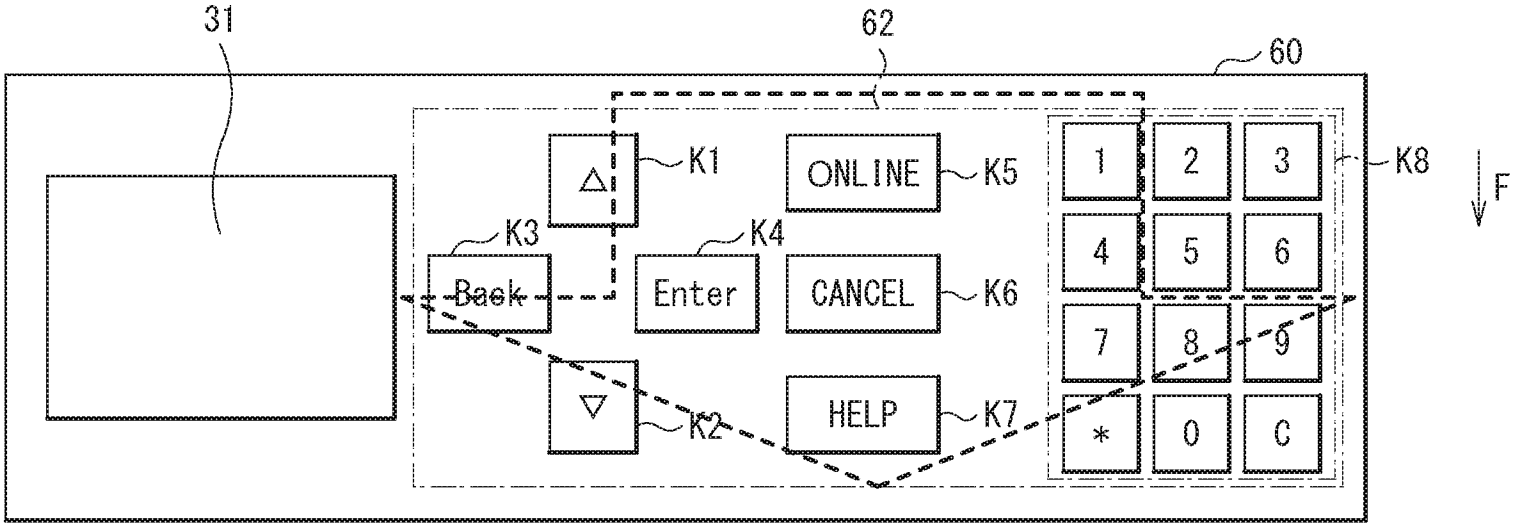
FIG. 18 is an explanatory diagram illustrating a discharging direction of a medium in the image forming apparatus illustrated in FIG. 15.

That is, as illustrated in FIG. 18, the discharged medium 9 may move in the discharging direction F from an upper portion of the operation panel 60 toward a lower portion of the operation panel 60. Accordingly, in a case where the medium 9 is electrically charged, the medium 9 can sequentially turn on two or more touch keys K of the operation panel 60 from upper side toward lower side in a direction the same as the discharging direction F. In the release operation OP, the user may sequentially turn on the three touch keys K from the lower side toward the upper side in a direction opposite to the discharging direction F, as illustrated in FIG. 17. That is, the turning-on order of the touch keys K in a case where the touch keys K are turned on by the electrically-charged medium 9 and the turning-on order of the touch keys K in a case where the touch keys K are turned on by the release operation OP may be different from each other. This allows for reduction in a possibility that the release operation OP is detected erroneously when the electrically-charged medium 9 moves in the discharging direction F in the image forming apparatus 2. As a result, it is possible to appropriately cause the operation mode to be returned to the effective mode M11 on the basis of the user's operation in the image forming apparatus 2.

The operation of turning on the "Down" key K2, the "Enter" key K4, and the "ONLINE" key K5 in this order may involve moving a finger from lower left toward upper right on the operation panel 60, as illustrated in FIG. 17. Such operation may be easily performed by a right-handed user, for example. Note that such operation is non-limiting. In one example embodiment, the "HELP" key K7, the "Enter" key K4, and the "Up" key K1 may be turned on in this order. This operation may involve moving a finger from lower right toward upper left on the operation panel 60, and may be therefore easily performed by a left-handed user, for example. In another example embodiment, the "HELP" key K7, the "CANCEL" key K6, and the "ONLINE" key K5 may be turned on in this order. This operation may involve moving a finger from the lower side toward the upper side on the operation panel 60, and may be therefore performed by both the right-handed user and the left-handed user.

Hereinafter, the touch key K to be touched first in the release operation OP is referred to as a "touch key KEY1", the touch key K to be touched next is referred to as a "touch key KEY2", and the touch key K to be touched last is referred to as a "touch key KEY3". In the example illustrated in FIG. 17, the "Down" key K2 may correspond to the touch key KEY1, the "Enter" key K4 may correspond to the touch key KEY2, and the "ONLINE" key K5 may correspond to the touch key KEYS.

The backlight control section 75 may control operation of the backlight section 63. In one specific but non-limiting example, the backlight control section 75 may cause the light-emitting devices corresponding to the respective touch keys K to emit light in the effective mode M11. In the ineffective mode M12, the backlight control section 75 may perform guiding backlight operation in order to prompt the user to perform the release operation OP. The guiding backlight operation may involve causing three light-emitting devices corresponding to the "Down" key K2, the "Enter" key K4, and the "ONLINE" key K5 related to the release operation OP to emit light in order.

The speaker controller 64 may control the speaker 45 to output the effective-state sound or the ineffective-state sound in a case where the touch key K in the touch key section 62 is turned on, for example. For example, in the effective mode M11, the speaker controller 64 may control the speaker 45 to output the effective-state sound in a case where an effective touch key K of the two or more touch keys K in the touch key section 62 is turned on, and the speaker controller 64 may control the speaker 45 to output the ineffective-state sound in a case where an ineffective touch key K of the two or more touch keys K in the touch key section 62 is turned on. In the ineffective mode M12, the speaker controller 64 may control the speaker 45 to output neither the effective-state sound nor the ineffective-state sound in a case where the touch key K is turned on.

The image formation controller 42C may include the conveyance control section 43C. The conveyance control section 43C may detect a timing at which the leading edge of the discharged medium 9 reaches the operation panel 60.

The controller 66 may control overall operation of the image forming apparatus 2.

The operation panel 60 may correspond to the "operation section" in one specific but non-limiting embodiment of the technology. The operation panel controller 70 and the controller 66 may correspond to the "operation controller" in one specific but non-limiting embodiment of the technology. The effective mode M11 may correspond to the "detection mode" in one specific but non-limiting embodiment of the technology. The ineffective mode M12 may correspond to the "limiting mode" in one specific but non-limiting embodiment of the technology. The touch key KEY1 may correspond to a "first sensor" in one specific but non-limiting embodiment of the technology. The touch key KEY3 may correspond to a "second sensor" in one specific but non-limiting embodiment of the technology.

Figure 19A:
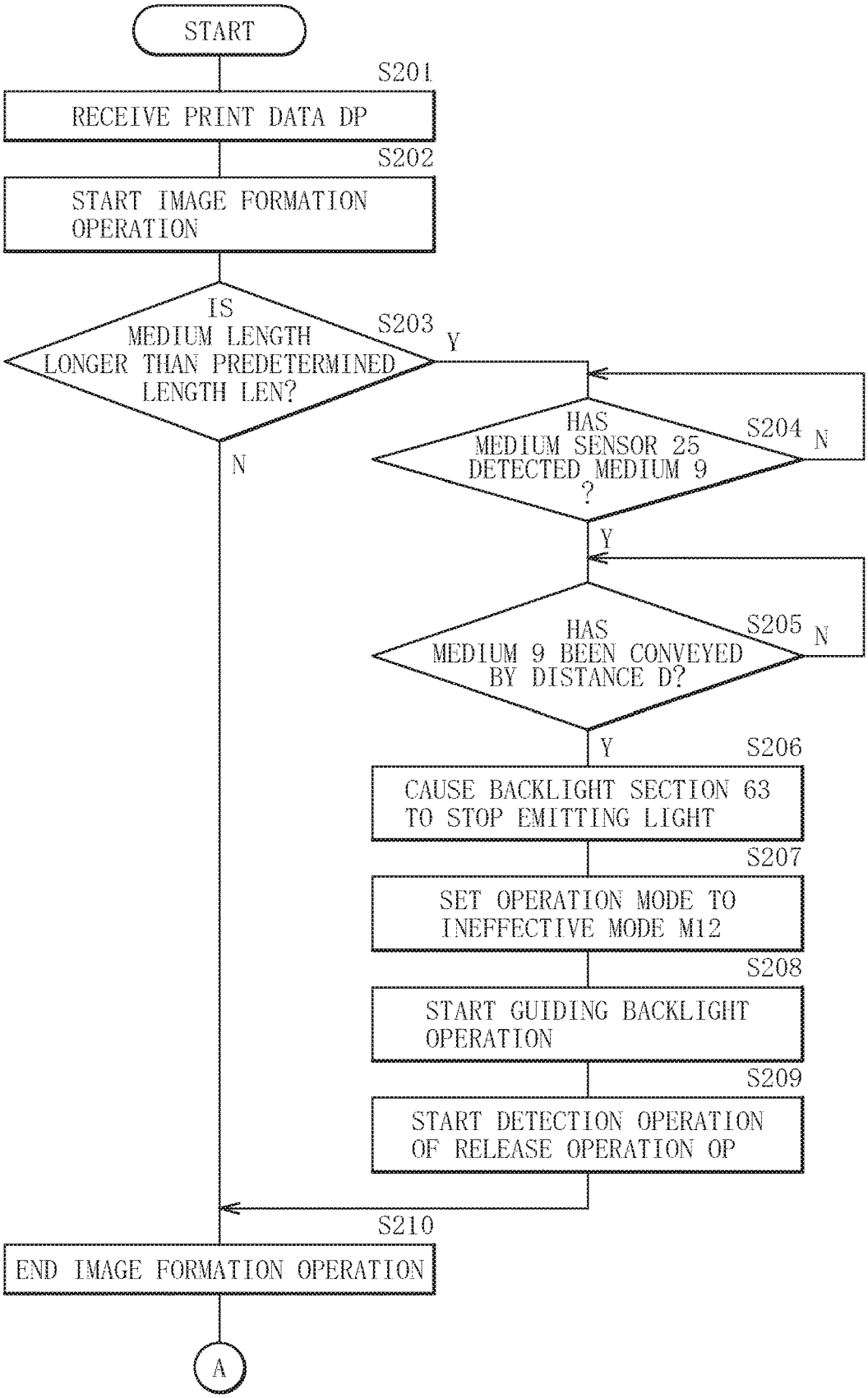
FIG. 19A is a flowchart illustrating an operation example of the image forming apparatus illustrated in FIG. 15.
Figure 19B:
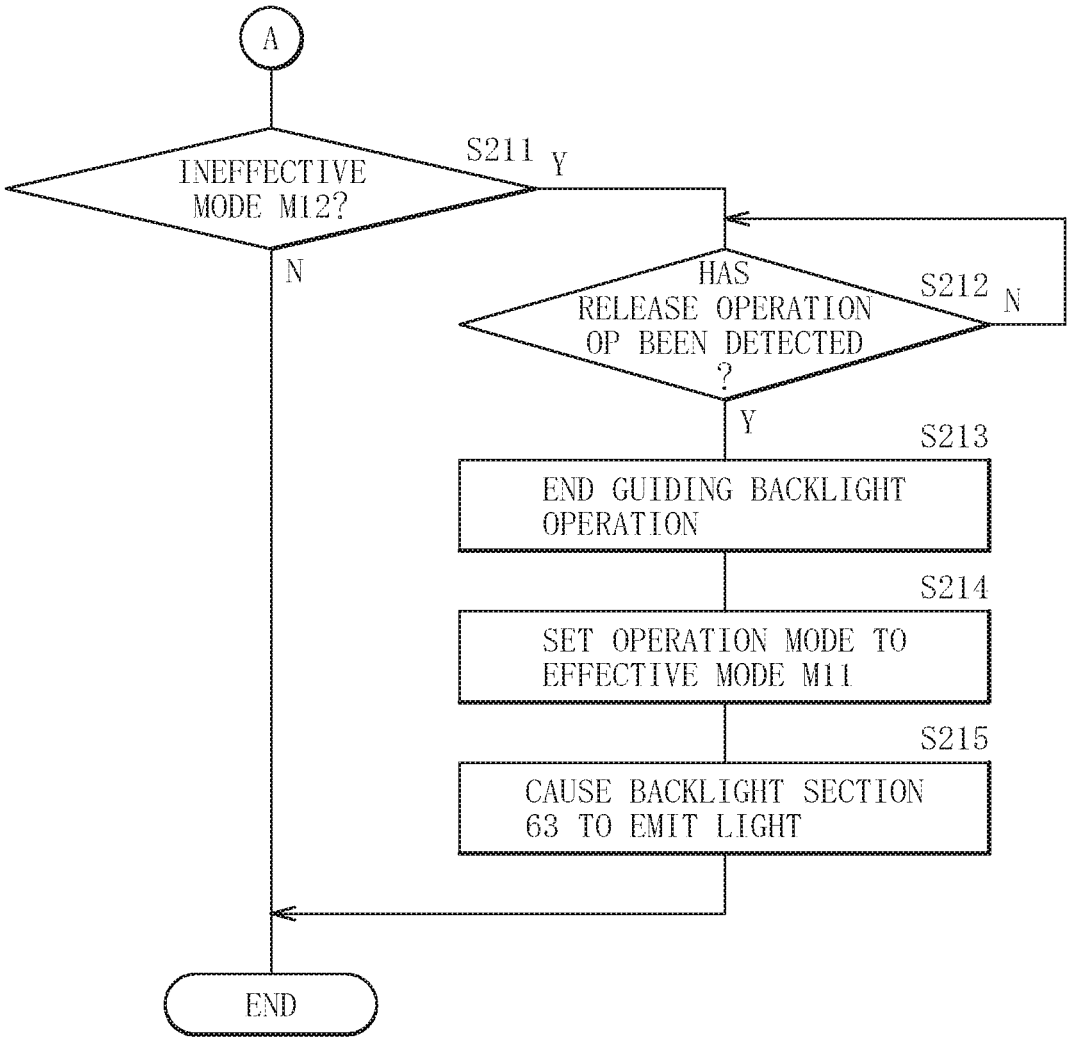
FIG. 19B is another flowchart illustrating the operation example of the image forming apparatus illustrated in FIG. 15.

FIGS. 19A and 19B each illustrate an operation example of the image forming apparatus 2. The image forming apparatus 2 may set the operation mode to the effective mode M11, for example, in a case where the image forming apparatus 2 is in a standby state. Upon receiving the print data DP, the image forming apparatus 2 may determine whether the medium length is longer than the predetermined length LEN on the basis of the size information INF included in the print data DP. In a case where the medium length is longer than the predetermined length LEN, the image forming apparatus 2 may set the operation mode to the ineffective mode M12. Further, in a case where the touch key section 62 detects the user's release operation OP in the ineffective mode M12, the image forming apparatus 2 may cause the operation mode to be returned to the effective mode M11. This operation is described below in detail.

First, the communication section 41 of the image forming apparatus 2 may receive the print data DP supplied from the information processor 8 (step S201). The image formation controller 42 may control the image formation operation of the image forming apparatus 2 on the basis of the received print data DP, and thereby cause the image forming apparatus 2 to start the image formation operation (step S202).

Thereafter, the medium length determining section 47 of the controller 66 may determine whether the medium length is longer than the predetermined length LEN on the basis of the size information INF included in the print data DP which the communication section 41 has received in step S201 (step S203). In a case where the medium length is not longer than the predetermined length LEN ("N" in step S203), the process may be caused to proceed to step S210.

In a case where the medium length is longer than the predetermined length LEN in step S203 ("Y" in step S203), the conveyance control section 43C of the image formation controller 42C may confirm whether the medium sensor 25 disposed near the discharging slot 27 has detected the leading edge of the medium 9 (step S204). In a case where the medium sensor 25 has not detected the leading edge of the medium 9 ("N" in step S204), the process in step S204 may be performed repeatedly until the medium sensor 25 detects the leading edge of the medium 9.

In a case where the medium sensor 25 has detected the leading edge of the medium 9 in step S204 ("Y" in step S204), the conveyance control section 43C may confirm whether the medium 9 has been conveyed by the predetermined distance D after the detection of the leading edge of the medium 9 (step S205). The predetermined distance D may be the distance from the medium sensor 25 to the end of the operation panel 60 via the discharging slot 27 and the discharging tray 28, for example. In a case where the medium 9 has not been conveyed by the predetermined distance D yet ("N" in step S205), a process in step S205 may be performed repeatedly until the medium 9 is conveyed by the predetermined distance D.

In a case where the medium 9 has been conveyed by the predetermined distance D in step S205 ("Y" in step S205), the backlight control section 75 may cause all of the light-emitting devices of the backlight section 63 to stop emitting light (step S206). Thereafter, the operation setting section 73 of the touch key control section 72 may set the operation mode to the ineffective mode M12 (step S207). The touch key control section 72 may thereby make the process based on the detection result from the touch key section 62 ineffective even when the touch key K is turned on, after the operation mode is set to the ineffective mode M12. This may allow for prevention of erroneous detection due to the electrically-charged medium 9, for example. Further, the speaker controller 64 may control the speaker 45 to output neither the effective-state sound nor the ineffective-state sound even when the touch key K is turned on, after the operation mode is set to the ineffective mode M12.

Thereafter, the backlight control section 75 may start the guiding backlight operation in order to prompt the user to perform the release operation OP (step S208). In one specific but non-limiting example, the backlight control section 75 may set a guiding backlight flag. The backlight control section 75 may thereby start the guiding backlight operation.

Figure 20:
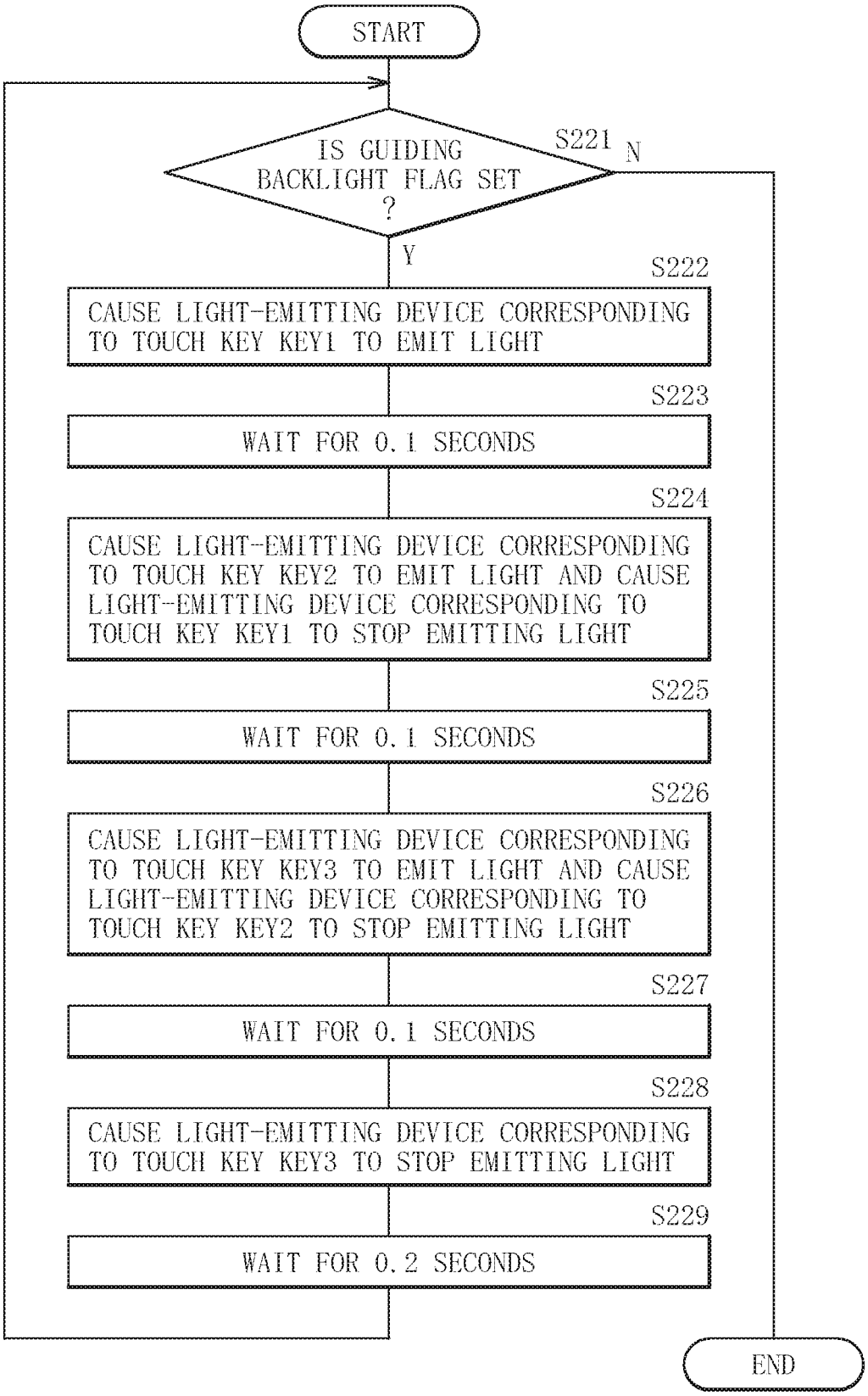
FIG. 20 is a flowchart illustrating an example of guiding backlight operation of the image forming apparatus illustrated in FIG. 15.

FIG. 20 illustrates an example of the guiding backlight operation. This operation may be performed in parallel with the operation illustrated in FIGS. 19A and 19B. First, the backlight control section 75 may confirm whether the guiding backlight flag is set (step S221). In a case where the guiding backlight flag is set ("Y" in step S221), the backlight control section 75 may cause a light-emitting device corresponding to the touch key KEY1 (e.g., the "Down" key K2) of the two or more light-emitting devices of the backlight section 63 to emit light (step S222), and wait for 0.1 seconds (step S223). Thereafter, the backlight control section 75 may cause a light-emitting device corresponding to the touch key KEY2 (e.g., the "Enter" key K4) of the light-emitting devices of the backlight section 63 to emit light, and cause a light-emitting device corresponding to the touch key KEY1 (e.g., the "Down" key K2) to stop emitting light (step S224). Thereafter, the backlight control section 75 may wait for 0.1 seconds (step S225). Thereafter, the backlight control section 75 may cause a light-emitting device corresponding to the touch key KEY3 (e.g., the "ONLINE" key K5) of the light-emitting devices of the backlight section 63 to emit light, and cause the light-emitting device corresponding to the touch key KEY2 (e.g., the "Enter" key K4) to stop emitting light (step S226). Thereafter, the backlight control section 75 may wait for 0.1 seconds (step S227). Thereafter, the backlight control section 75 may cause the light-emitting device corresponding to the touch key KEY3 (e.g., the "ONLINE" key K5) of the light-emitting devices of the backlight section 63 to stop emitting light (step S228). Thereafter, the backlight control section 75 may wait for 0.2 seconds (step S229). Thereafter, the process may be caused to return to step S221. The backlight control section 75 may repeatedly perform the operation in steps S221 to S229 until the guiding backlight flag is reset. In a case where the guiding backlight flag is reset in step S221 ("N" in step S221), the process may be brought to an end of the flow.

The guiding backlight operation may cause the light-emitting device corresponding to the touch key KEY1 (e.g. the "Down" key K2), the light-emitting device corresponding to the touch key KEY2 (e.g., the "Enter" key K4), and the light-emitting device according to the touch key KEY3 (e.g., the "ONLINE" key K5) of the light-emitting devices of the backlight section 63 to emit light repeatedly in this order. The user may run his or her finger on the touch key KEY1, the touch key KEY2, and the touch key KEY3 in this order in accordance with the light-emitting pattern, and thereby perform the release operation OP.

Thereafter, as illustrated in FIG. 19A, the release operation detecting section 74 of the touch key control section 72 may start the detection operation of the release operation OP (step S209).

Figure 21:
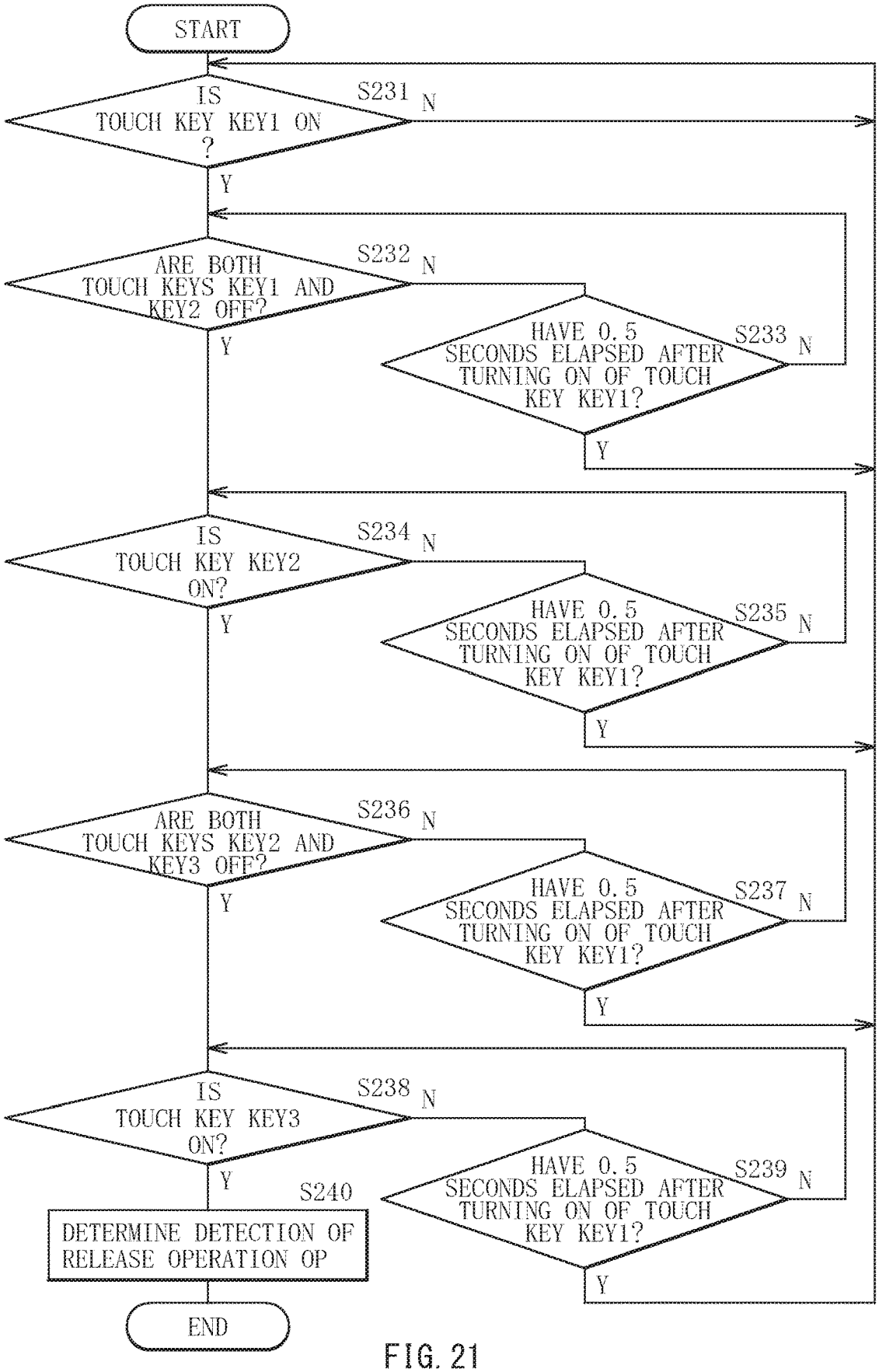
FIG. 21 is a flowchart illustrating an example of detection operation of the release operation of the image forming apparatus illustrated in FIG. 15.

FIG. 21 illustrates an example of a detection operation of the release operation OP. This operation may be performed in parallel with the operation illustrated in FIGS. 19A and 19B. The ON state and the OFF state of the touch key K may be detected at intervals from about 10 msec to about 20 msec, for example.

First, the release operation detecting section 74 may confirm whether the touch key KEY1 (e.g., the "Down" key K2) is in the ON state (step S231). In a case where the touch key KEY1 is not in the ON state ("N" in step S231), the release operation detecting section 74 may repeatedly perform the process in step S231 until the touch key KEY1 is turned on.

In a case where the touch key KEY1 (e.g., the "Down" key K2) is in the ON state in step S231 ("Y" in step S231), the release operation detecting section 74 may confirm whether both of the touch key KEY1 (e.g., the "Down" key K2) and the touch key KEY2 (e.g., the "Enter" key K4) are in the OFF state (step S232). In a case where both of the touch keys KEY1 and KEY2 are not in the OFF state ("N" in step S232), the release operation detecting section 74 may confirm whether 0.5 seconds have elapsed after turning on of the touch key KEY1 (step S233). In a case where 0.5 seconds have not elapsed yet after the turning on of the touch key KEY1 ("N" in step S233), the process may be caused to return to step S232. In a case where 0.5 seconds have elapsed after the turning on of the touch key KEY1 ("Y" in step S233), the process may be caused to return to step S231.

In a case where both of the touch keys KEY1 and KEY2 are in the OFF state in step S232 ("Y" in step S232), the release operation detecting section 74 may confirm whether the touch key KEY2 (e.g., the "Enter" key K4) is in the ON state (step S234). In the case where the touch key KEY2 is not in the ON state ("N" in step S234), the release operation detecting section 74 may confirm whether 0.5 seconds have elapsed after turning on of the touch key KEY1 (step S235). In a case where 0.5 seconds have not elapsed yet after the turning on of the touch key KEY1 ("N" in step S235), the process may be caused to return to step S234. In a case where 0.5 seconds have elapsed after the turning on of the touch key KEY1 ("Y" in step S235), the process may be caused to return to step S231.

In a case where the touch key KEY2 is in the ON state in step S234 ("Y" in step S234), the release operation detecting section 74 may confirm whether both of the touch key KEY2 (e.g., the "Enter" key K4) and the touch key KEY3 (e.g., the "ONLINE" key K5) are in the OFF state (step S236). In a case where both of the touch keys KEY2 and KEY3 are not in the OFF state ("N" in step S236), the release operation detecting section 74 may confirm whether 0.5 seconds have elapsed after turning on of the touch key KEY1 (step S237). In a case where 0.5 seconds have not elapsed yet after the turning on of the touch key KEY1 ("N" in step S237), the process may be caused to return to step S236. In a case where 0.5 seconds have elapsed after the turning on of the touch key KEY1 ("Y" in step S237), the process may be caused to return to step S231.

In a case where both of the touch keys KEY2 and KEY3 are in the OFF state in step S236 ("Y" in step S236), the release operation detecting section 74 may confirm whether the touch key KEY3 (e.g., the "ONLINE" key K5) is in the ON state (step S238). In the case where the touch key KEY3 is not in the ON state ("N" in step S238), the release operation detecting section 74 may confirm whether 0.5 seconds have elapsed after turning on of the touch key KEY1 (step S239). In a case where 0.5 seconds have not elapsed yet after the turning on of the touch key KEY1 ("N" in step S239), the process may be caused to return to step S238. In a case where 0.5 seconds have elapsed after the turning on of the touch key KEY1 ("Y" in step S239), the process may be caused to return to step S231.

In a case where the touch key KEY3 is in the ON state in step S238 ("Y" in step S238), the release operation detecting section 74 may determine that the release operation OP is detected. That is, the release operation detecting section 74 may determine in this case that the release operation OP is detected because the "Down" key K2, the "Enter" key K4, and the "ONLINE" key K5 have been turned on in this order. Thereafter, the process may be brought to an end of the flow.

In this detection operation, the process may be caused to return to step S231 in a case where the detection operation is not brought to the end within 0.5 seconds after the turning on of the touch key KEY1, as in steps S233, S235, S237, and S239. It may be expected that the swipe operation is to be completed within about 0.2 seconds to about 0.3 seconds. Therefore, in a case where the detection operation is not completed within 0.5 seconds after the turning on of the touch key KEY1, the release operation detecting section 74 may determine that the release operation OP is not being performed and cause the process to return to step S231. In a case where the detection operation is completed within 0.5 seconds, the release operation detecting section 74 may determine that the release operation OP is detected in step S240. The release operation detecting section 74 may start such detection operation in step S209 in FIG. 19A.

As a result of the image formation operation performed by the image forming apparatus 2, the medium 9 with the formed image may be discharged to the discharging tray 28. Further, the image forming apparatus 2 may end the image formation operation (step S210).

Thereafter, the operation setting section 73 may confirm whether the operation mode is set to the ineffective mode M12 (step S211). In a case where the operation mode is set to the effective mode M11 ("N" in step S211), the process may be brought to an end of the flow. In a case where the operation mode is set to the ineffective mode M12 ("Y" in step S211), the release operation detecting section 74 may confirm whether the release operation OP has been detected in step S240 illustrated in FIG. 21 (step S212). In a case where the release operation OP has not been detected ("N" in step S212), the release operation detecting section 74 may repeatedly perform the process in step S212 until the release operation OP is detected.

In a case where the release operation OP has been detected in step S212 ("Y" in step S212), the backlight control section 75 may end the guiding backlight operation illustrated in FIG. 20 (step S213). In one specific but non-limiting example, the backlight control section 75 may reset the guiding backlight flag. This may allow the backlight control section 75 to confirm, in step S221 illustrated in FIG. 20, that the guiding backlight flag has been reset ("N" in step S221), and the backlight control section 75 may therefore end the guiding backlight operation.

Thereafter, the operation setting section 73 of the touch key control section 72 may set the operation mode to the effective mode M11 (step S214). Thereafter, the backlight control section 75 may cause all of the light-emitting devices of the backlight section 63 to emit light (step S215).

This may bring the process to an end of the flow. This may cause the touch key control section 72 to make the process based on the detection result from the touch key section 62 effective after the process of the flow has been ended. The speaker controller 64 may control the speaker 45 to output the effective-state sound in a case where the effective touch key K of the two or more touch keys K in the touch key section 62 is turned on, and may control the speaker 45 to output the ineffective-state sound in a case where the ineffective touch key K of the two or more touch keys K in the touch key section 62 is turned on.

As described above, in the image forming apparatus 2, the detection operation of the touch key section 62 may be limited on the basis of the size information INF indicating the information related to the medium size of the medium 9. For example, in a case where the medium length of the medium 9 is determined to be longer than the predetermined length LEN on the basis of the size information INF, the operation setting section 73 may set the operation mode to the ineffective mode M12 and thereby make the process based on the detection result from the touch key section 62 ineffective. This allows for reduction in a possibility that the touch key section 62 performs erroneous detection due to the electrically-charged medium 9 in the image forming apparatus 2. As a result, it is possible to reduce a possibility that erroneous operation is performed in the image forming apparatus 2.

Moreover, in the image forming apparatus 2, the speaker 45 may be caused to output neither the effective-state sound nor the ineffective-state sound when the touch key K is turned on in the ineffective mode M12. This may cause the speaker 45 to output neither the effective-state sound nor the ineffective-state sound even in a case where the electrically-charged medium 9 comes into contact with the touch key section 62, preventing the user from being disturbed by the sound. As a result, it is possible to improve user friendliness.

Moreover, in the image forming apparatus 2, the release operation OP may cause the operation mode to be returned from the ineffective mode M12 to the effective mode M11. The release operation OP may be operation of sequentially turning on the touch keys K in the direction opposite to the discharging direction F. This allows for reduction in a possibility that the release operation OP is detected due to the electrically-charged medium 9, allowing the operation mode to be appropriately returned to the effective mode M11.

According to the second example embodiment, detection operation of a touch key section may be limited on the basis of size information indicating information related to a medium size of a medium, as described above. As a result, it is possible to reduce a possibility that erroneous operation is performed.

According to the second example embodiment, a speaker may be caused to output neither an effective-state sound nor an ineffective-state sound in an ineffective mode. As a result, it is possible to improve user friendliness.

According to the second example embodiment, release operation may cause an operation mode to be returned from the ineffective mode to an effective mode. The release operation is operation of sequentially turning on the touch keys in a direction opposite to a discharging direction. As a result, it is possible to allow the operation mode to be appropriately returned to the effective mode.

[Modification 2-1]

Although the turning on of the predetermined touch keys KEY1, KEY2, and KEY3 in this order may cause the operation mode to be returned to the effective mode M11 in the second example embodiment, this is non-limiting. Modification 2-1 is described in detail below.

Figure 22:
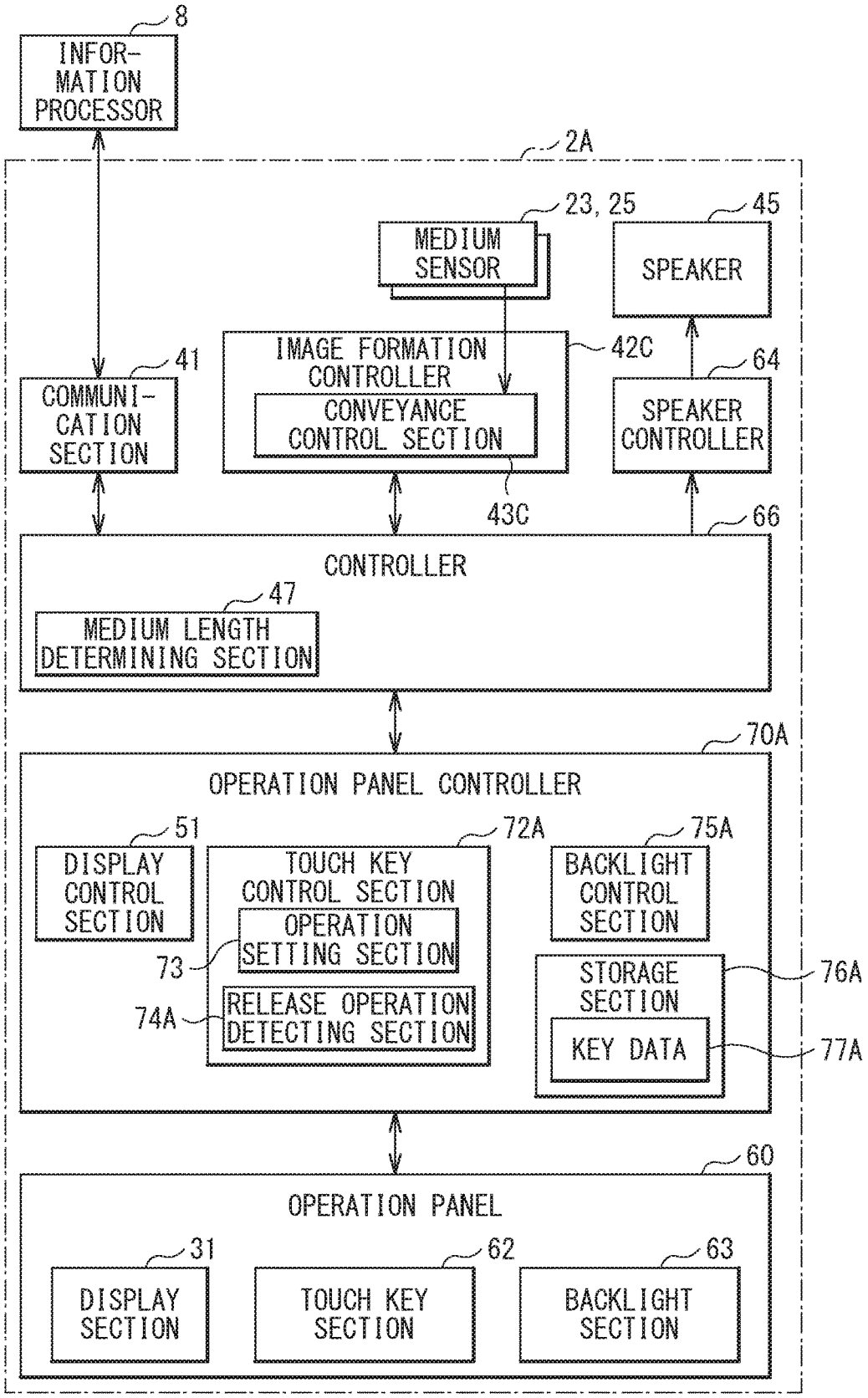
FIG. 22 is a block diagram illustrating a configuration of an image forming apparatus according to a modification of the second example embodiment.

FIG. 22 illustrates a configuration example of an image forming apparatus 2A according to Modification 2-1. The image forming apparatus 2A may include an operation panel controller 70A. The operation panel controller 70A may include a touch key control section 72A, a storage section 76A, and a backlight control section 75A.

The touch key control section 72A may include a release operation detecting section 74A. The release operation detecting section 74A may detect release operation OP2 performed by the user in the ineffective mode M12.

Figure 23:
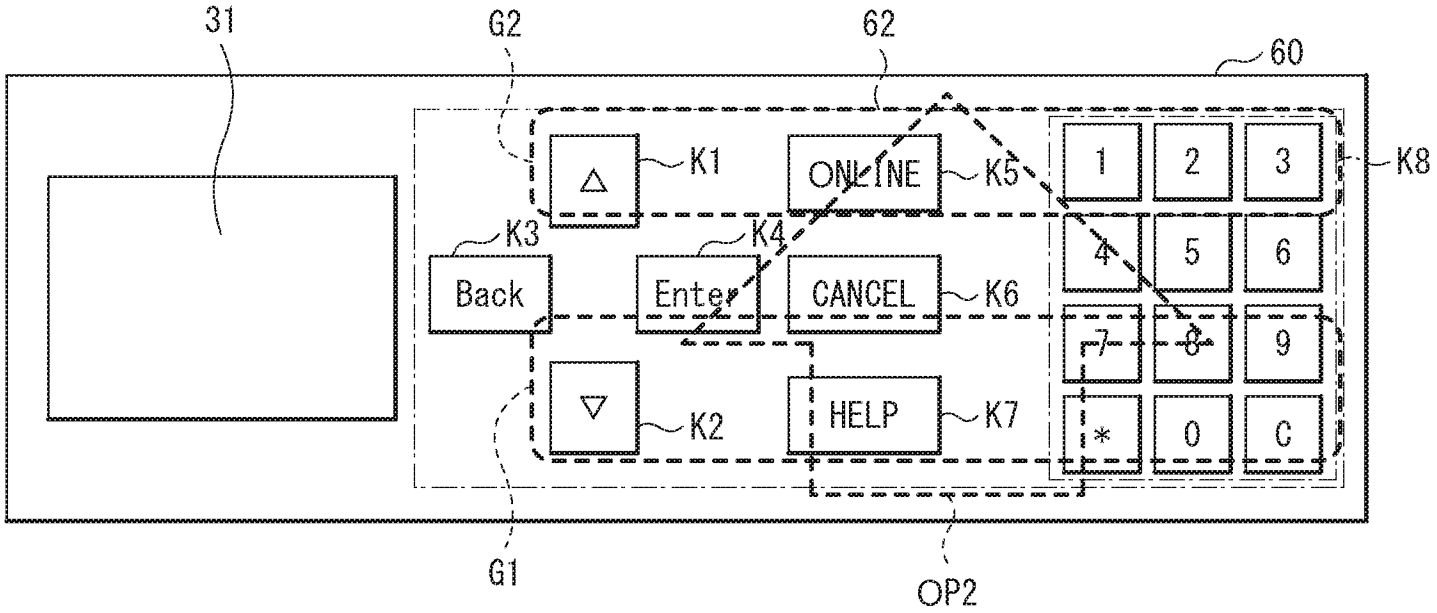
FIG. 23 is an explanatory diagram illustrating an example of release operation of an image forming apparatus illustrated in FIG. 22.

FIG. 23 illustrates an example of the release operation OP2. In this example, the release operation OP2 may involve: turning on any of touch keys K included in a key group G1; and thereafter turning on any of touch keys K included in a key group G2. The key group G1 may include eight touch keys K disposed near the lower end of the operation panel 60 of the touch keys K in the touch key section 62, i.e., the "Down" key K2, the "HELP" key K7, and a "7" key, an "8" key, a "9" key, a "0" key, an "*" key, and a "C" key of the number keys K8, in this example. The key group G2 may include five touch keys K disposed near the upper end of the operation panel 60 of the touch keys K in the touch key section 62, i.e., the "Up" key K1, the "ONLINE" key K5, and a "1" key, a "2" key, and a "3" key of the number keys K8 in this example. That is, the release operation OP2 may cause the user to sequentially turn on two touch keys K from the lower side toward the upper side in the direction opposite to the discharging direction F, as illustrated in FIG. 23.

The storage section 76A may include, for example but not limited to, a non-volatile memory. The storage section 76A may hold key data 77A. As illustrated in FIG. 24, the key data 77A may include information related to the touch keys K belonging to the key group G1 and information related to the touch keys K belonging to the key group G2.

In the ineffective mode M12, the release operation detecting section 74A may detect the release operation OP2 on the basis of the key data 77A stored in the storage section 76A. In a case where the release operation detecting section 74A detects the release operation OP2, the operation setting section 73 may change the operation mode from the ineffective mode M12 to the effective mode M11.

Hereinafter, the touch key K to be touched first in the release operation OP2 is referred to as a "touch key KEY11" and the touch key K to be touched last in the release operation OP2 is referred to as a "touch key KEY12".

In the effective mode M11, the backlight control section 75A may cause light-emitting devices corresponding to the touch keys K to emit light. In the ineffective mode M12, the backlight control section 75A may cause light-emitting devices corresponding to the touch keys K to stop emitting light.

Figure 25A:
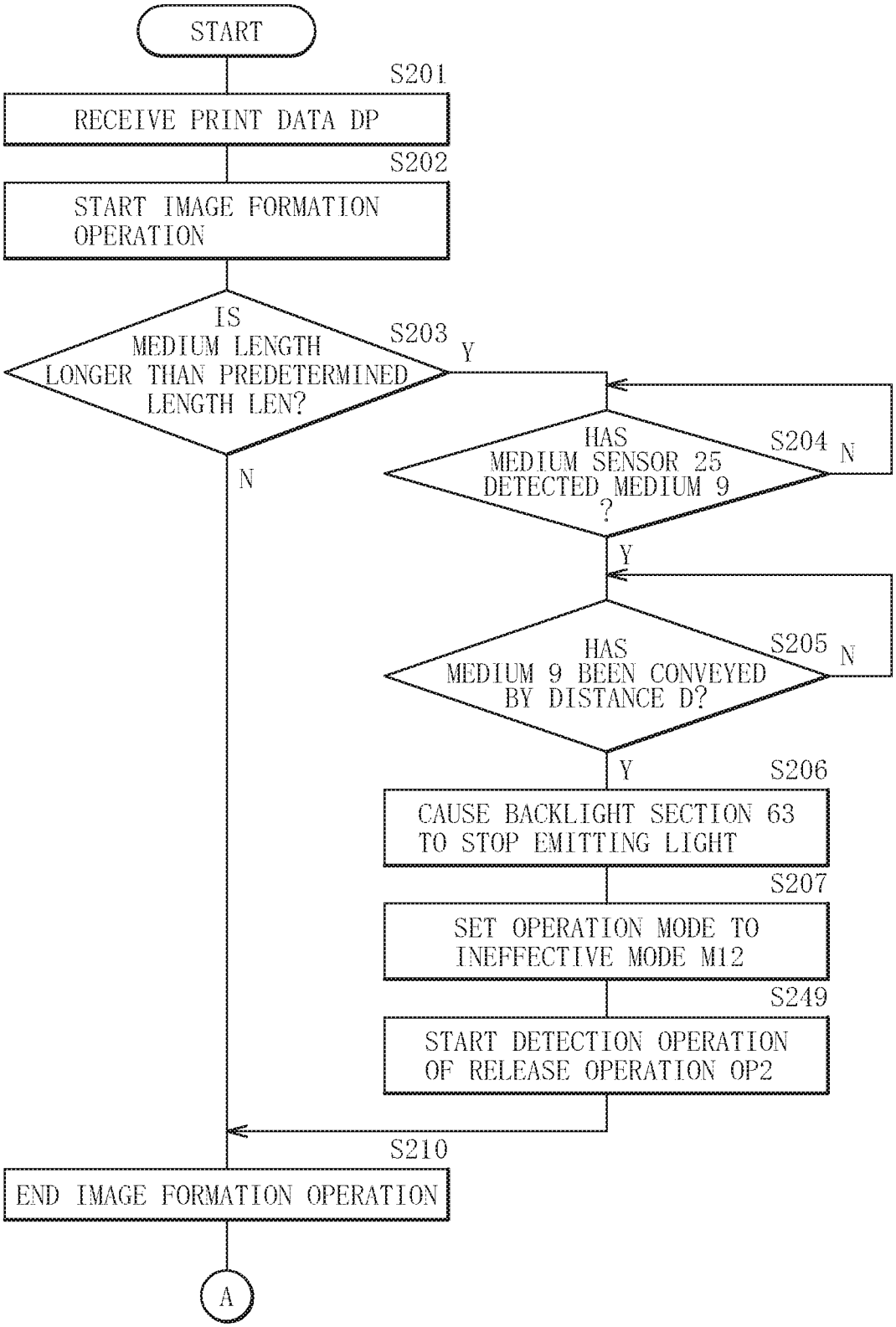
FIG. 25A is a flowchart illustrating an operation example of the image forming apparatus illustrated in FIG. 22.
Figure 25B:
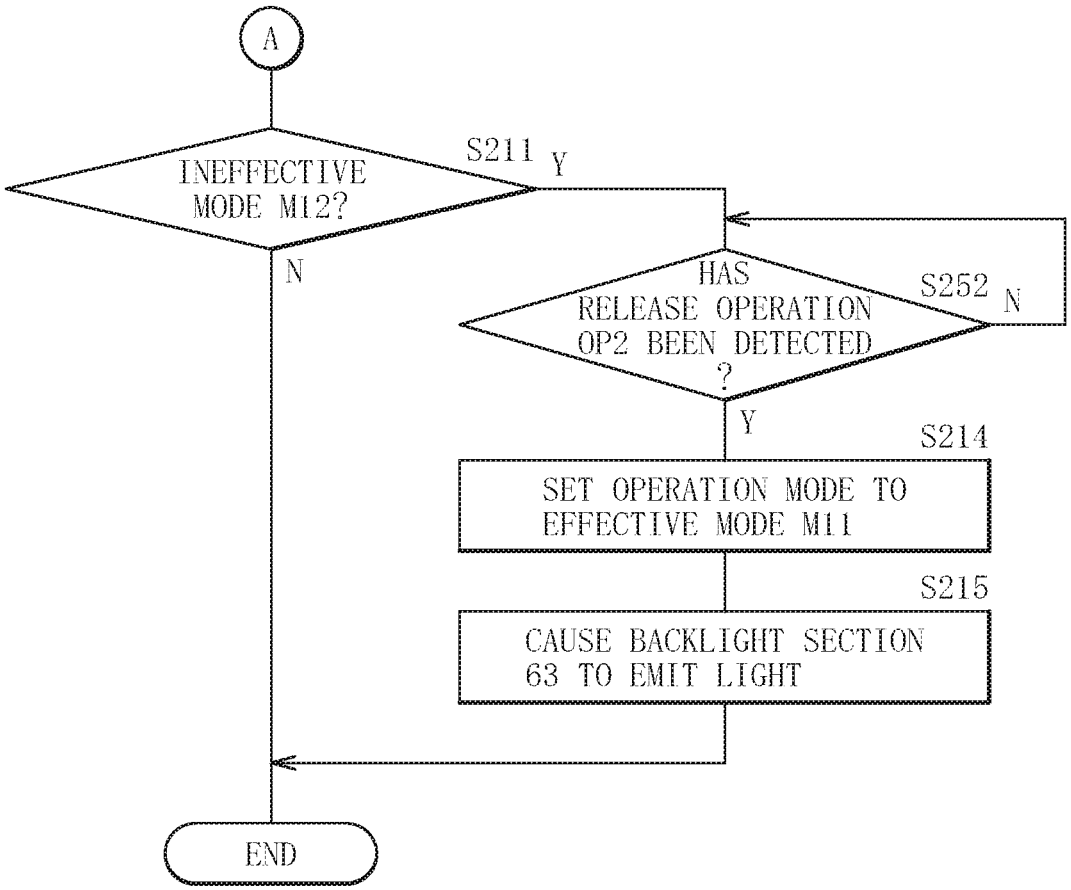
FIG. 25B is another flowchart illustrating the operation example of the image forming apparatus illustrated in FIG. 22.

FIGS. 25A and 25B each illustrate an operation example of the image forming apparatus 2A.

First, the communication section 41 of the image forming apparatus 2A may receive the print data DP supplied from the information processor 8 (step S201). The image formation controller 42 may control the image formation operation of the image forming apparatus 2A on the basis of the received print data DP, and thereby cause the image forming apparatus 2A to start the image formation operation (step S202).

Thereafter, the medium length determining section 47 of the controller 66 may determine whether the medium length is longer than the predetermined length LEN on the basis of the size information INF included in the print data DP which the communication section 41 has received in step S201 (step S203). In a case where the medium length is not longer than the predetermined length LEN ("N" in step S203), the process may be caused to proceed to step S210.

In a case where the medium length is longer than the predetermined length LEN in step S203 ("Y" in step S203), the conveyance control section 43C of the image formation controller 42C may confirm whether the medium sensor 25 disposed near the discharging slot 27 has detected the leading edge of the medium 9 (step S204). In a case where the medium sensor 25 has not detected the leading edge of the medium 9 ("N" in step S204), the process in step S204 may be performed repeatedly until the medium sensor 25 detects the leading edge of the medium 9.

In a case where the medium sensor 25 has detected the leading edge of the medium 9 in step S204 ("Y" in step S204), the conveyance control section 43C may confirm whether the medium 9 has been conveyed by the predetermined distance D after the detection of the leading edge of the medium 9 (step S205). In a case where the medium 9 has not been conveyed by the predetermined distance D yet ("N" in step S205), a process in step S205 may be performed repeatedly until the medium 9 is conveyed by the predetermined distance D.

In a case where the medium 9 has been conveyed by the predetermined distance D in step S205 ("Y" in step S205), the backlight control section 75A may cause all of the light-emitting devices of the backlight section 63 to stop emitting light (step S206). Thereafter, the operation setting section 73 of the touch key control section 72A may set the operation mode to the ineffective mode M12 (step S207).

Thereafter, the release operation detecting section 74A of the touch key control section 72A may start the detection operation of the release operation OP2 on the basis of the key data 77A stored in the storage section 76A (step S249).

Figure 26:
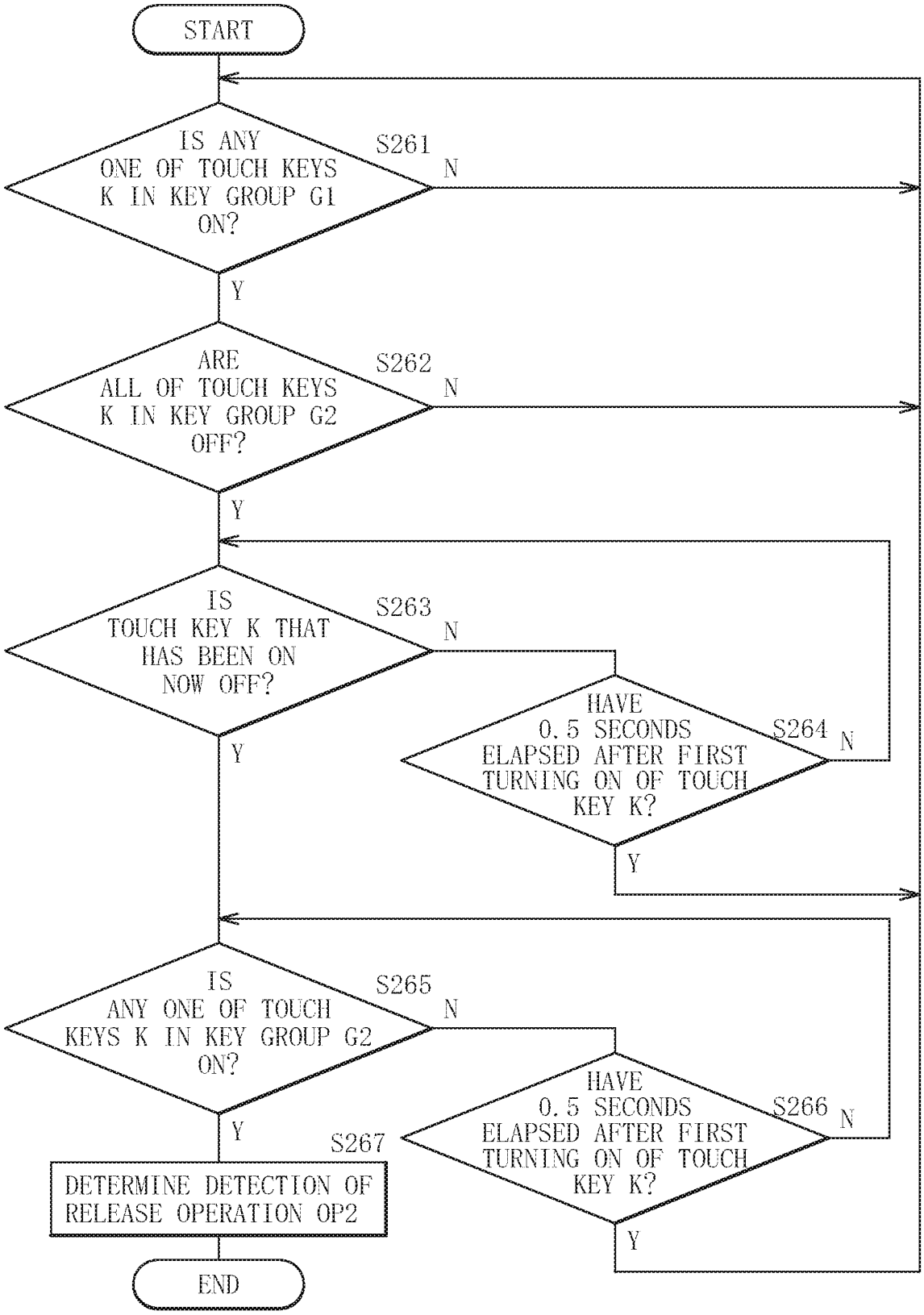
FIG. 26 is a flowchart illustrating an example of detection operation of release operation of the image forming apparatus illustrated in FIG. 22.

FIG. 26 illustrates an example of the detection operation of the release operation OP2. This operation may be performed in parallel with the operation illustrated in FIGS. 25A and 25B.

First, the release operation detecting section 74A may confirm whether any one of the touch keys K included in the key group G1 is in the ON state (step S261). In a case where all of the touch keys K included in the key group G1 are in the OFF state ("N" in step S261), the release operation detecting section 74A may repeatedly perform the process in step S261 until any one of the touch keys K included in the key group G1 is turned on.

In a case where any one (the touch key KEY11) of the touch keys K included in the key group G1 is in the ON state ("Y" in step S261), the release operation detecting section 74A may confirm whether all of the touch keys K included in the key group G2 are in the OFF state (step S262). In a case where not all of the touch keys K included in the key group G2 are in the OFF state ("N" in step S262), the process may be caused to return to step S261.

In a case where all of the touch keys K included in the key group G2 are in the OFF state in step S262 ("Y" in step S262), the release operation detecting section 74A may confirm whether the touch key K (the touch key KEY11) that has been in the ON state in step S261 is now in the OFF state (step S263). In a case the touch key K (the touch key KEY11) that has been in the ON state in step S261 is now not in the OFF state ("N" in step S263), the release operation detecting section 74A may confirm whether 0.5 seconds have elapsed after first turning on of the touch key K (the touch key KEY11) (step S264). In a case where 0.5 seconds have not elapsed yet after the first turning on of the touch key K (the touch key KEY11) ("N" in step S264), the process may be caused to return to step S263. In a case where 0.5 seconds have elapsed after the first turning on of the touch key KEY (the touch key KEY11) ("Y" in step S264), the process may be caused to return to step S261.

In a case where the touch key K (the touch key KEY11) that has been in the ON state is now in the OFF state ("Y" in step S263), the release operation detecting section 74A may confirm whether any one of the touch keys K included in the key group G2 is in the ON state (step S265). In a case where all of the touch keys K included in the key group G2 are in the OFF state ("N" in step S265), the release operation detecting section 74A may confirm whether 0.5 seconds have elapsed after first turning on of the touch key K (the touch key KEY11) (step S266). In a case where 0.5 seconds have not elapsed yet after the first turning on of the touch key K (the touch key KEY11) ("N" in step S266), the process may be caused to return to step S265. In a case where 0.5 seconds have elapsed after the first turning on of the touch key KEY (the touch key KEY11) ("Y" in step S266), the process may be caused to return to step S261.

In a case where any one (the touch key KEY12) of the touch keys K included in the key group G2 is in the ON state ("Y" in step S265), the release operation detecting section 74A may determine that the release operation OP2 is detected. This may bring the process to an end of the flow. The release operation detecting section 74A may start the detection operation described above in step S249 illustrated in FIG. 25A.

As a result of the image formation operation performed by the image forming apparatus 2A, the medium 9 with the formed image may be discharged to the discharging tray 28. Further, the image forming apparatus 2A may end the image formation operation (step S210).

Thereafter, the operation setting section 73 may confirm whether the operation mode is set to the ineffective mode M12 (step S211). In a case where the operation mode is set to the effective mode M11 ("N" in step S211), the process may be brought to an end of the flow. In a case where the operation mode is set to the ineffective mode M12 ("Y" in step S211), the release operation detecting section 74 may confirm whether the release operation OP2 has been detected in step S267 illustrated in FIG. 26 (step S252). In a case where the release operation OP2 has not been detected ("N" in step S252), the release operation detecting section 74A may repeatedly perform the process in step S252 until the release operation OP2 is detected.

In a case where the release operation OP2 has been detected in step S252 ("Y" in step S252), the operation setting section 73 of the touch key control section 72A may set the operation mode to the effective mode M11 (step S214). Thereafter, the backlight control section 75A may cause all of the light-emitting devices of the backlight section 63 to emit light (step S215).

This may bring the process to an end of the flow.

With this configuration, in the image forming apparatus 2A, it may be unnecessary for the user to pay attention to a particular touch key K to be used in the release operation OP, unlike in the release operation OP according to the second example embodiment. As a result, it is possible to improve user friendliness.

[Modification 2-2]

Although the print data DP may include the size information INF, i.e., the information related to the medium size of the medium 9, according to the second example embodiment, this is non-limiting. In one example embodiment, alternatively, the medium size of the medium 9 conveyed along the conveyance path 10 may be determined as in the image forming apparatus 1E according to Modification 1-5 of the first example embodiment.

One embodiment of the technology has been described above with reference to some example embodiments and the modifications thereof; however, one embodiment of the technology is not limited thereto and may be modified in a variety of ways.

For example, although one embodiment of the technology may be applied to a single-function printer according to the example embodiments and the modifications thereof described above, this is non-limiting. Alternatively, one embodiment of the technology may be applied to a multi-function peripheral (MFP) having multiple functions including, without limitation, a copying function, a faxing function, a scanning function, and a printing function.

Moreover, although one embodiment of the technology may be applied to a printer in the example embodiments and the modifications thereof described above, this is non-limiting. One embodiment of the technology is applicable to various apparatuses performing a process related to a medium. In one specific but non-limiting example, one embodiment of the technology may be applied to a scanning apparatus that acquires an image printed on a medium. For example, the medium can be electrically charged due to static electricity also in this case. Therefore, one embodiment of the technology is applicable in order to reduce a possibility that a touch sensor performs erroneous detection due to the electrically-charged medium.

Furthermore, the technology encompasses any possible combination of some or all of the various embodiments and the modifications described herein and incorporated herein. It is possible to achieve at least the following configurations from the above-described example embodiments of the technology.

(1)

A medium processing apparatus including a processor that performs a process related to a medium, the medium processing apparatus including:

a discharging section that discharges the medium;

an operation section that is disposed downstream of the discharging section in a discharging direction and includes a touch sensor, the discharging direction being a direction in which the discharging section discharges the medium, the touch sensor detecting an operation input; and an operation controller that limits, on the basis of size information, detection operation performed by the touch sensor, the size information indicating information related to a medium size of the medium.

(2)

The medium processing apparatus according to (1), in which the operation controller has a detection mode and a limiting mode, the detection mode allowing the touch sensor to detect the operation input, the limiting mode limiting the detection operation, the detection mode and the limiting mode each being to be set as an operation mode of the operation section, and the operation controller sets the operation mode to the limiting mode in a case where the medium size based on the size information is greater than a predetermined size.

(3)

The medium processing apparatus according to (2), further including:

a conveying section that conveys the medium along a conveyance path and thereby causes the medium to be discharged from the discharging section; and a medium sensor that is disposed on the conveyance path and detects the medium, in which the operation controller determines, on the basis of a timing at which the medium sensor detects the medium, a timing to switch the operation mode from the detection mode to the limiting mode.

(4)

The medium processing apparatus according to (2) or (3), in which the operation controller sets detection sensitivity of the touch sensor to first detection sensitivity in the detection mode, and the operation controller sets the detection sensitivity of the touch sensor to second detection sensitivity in the limiting mode, the second detection sensitivity being lower than the first detection sensitivity.

(5)

The medium processing apparatus according to (4), in which the operation controller switches the operation mode from the limiting mode to the detection mode on the basis of a result of the detection operation performed by the touch sensor in the limiting mode.

(6)

The medium processing apparatus according to (4), in which the operation controller includes a timer that performs counting operation, and the operation controller causes the timer to start the counting operation when the processor ends the process, and switches the operation mode from the limiting mode to the detection mode after the timer ends the counting operation.

(7)

The medium processing apparatus according to (6), further including an environment sensor that performs detection of an environment, in which the operation controller configures setting of the counting operation on the basis of a result of the detection performed by the environment sensor.

(8)

The medium processing apparatus according to any one of (4) to (6), in which the touch sensor compares a detected value and a threshold with each other and thereby performs the detection operation, the operation controller sets the threshold to a first threshold in the detection mode, and the operation controller sets the threshold to a second threshold in the limiting mode, the second threshold being higher than the first threshold.

(9)

The medium processing apparatus according to (8), in which the operation controller adjusts the second threshold on the basis of a result of the detection operation performed by the touch sensor in a case where the medium is discharged from the discharging section.

(10)

The medium processing apparatus according to (2) or (3), in which the operation controller causes a process based on a result of the detection operation performed by the touch sensor to be effective in the detection mode, and the operation controller causes the process based on the result of the detection operation performed by the touch sensor to be ineffective in the limiting mode.

(11)

The medium processing apparatus according to (10), in which the touch sensor includes two or more sensors, and the operation controller switches the operation mode from the limiting mode to the detection mode in a case where the two or more sensors are turned on in a predetermined sensor order.

(12)

The medium processing apparatus according to (11), in which the two or more sensors include a first sensor and a second sensor, the first sensor being to be turned on first in the predetermined sensor order, the second sensor being to be turned on last in the predetermined sensor order, and the first sensor is disposed downstream of the second sensor in the discharging direction in the operation section.

(13)

The medium processing apparatus according to (10), in which the touch sensor includes two or more first sensors and two or more second sensors, and the operation controller switches the operation mode from the limiting mode to the detection mode in a case where any of the second sensors is turned on after any of the first sensors is turned on.

(14)

The medium processing apparatus according to (13), in which the two or more first sensors are disposed downstream of the two or more second sensors in the discharging direction in the operation section.

(15)

The medium processing apparatus according to (10), further including:

a speaker; and a speaker controller that controls operation of the speaker, in which the speaker controller stops, in the limiting mode, the operation of the speaker based on the result of the detection operation performed by the touch sensor.

(16)

The medium processing apparatus according to any one of (1) to (15), in which the size information includes information related to a length of the medium in the discharging direction.

(17)

The medium processing apparatus according to any one of (1) to (16), further including:

a conveying section that conveys the medium along a conveyance path and thereby causes the medium to be discharged from the discharging section; and a medium sensor that is disposed on the conveyance path and performs detection of the medium, in which the operation controller generates the size information on the basis of a result of the detection performed by the medium sensor.

(18)

The medium processing apparatus according to any one of (1) to (17), further including a communication section that performs communication with an information processor and thereby receives the size information from the information processor.

(19)

A medium processing apparatus including a processor that performs a process related to a medium, the medium processing apparatus including:

a discharging section that discharges the medium;

an operation section that includes a touch sensor, the touch sensor detecting an operation input; and an operation controller that controls operation of the operation section, in which a portion or all of the operation section is covered with the medium in a case where a medium size of the medium discharged from the discharging section is greater than a predetermined size, and the operation controller limits the detection operation performed by the touch sensor in the case where the medium size is greater than the predetermined size.

(20)

A medium processing apparatus including a processor that performs a process related to a medium, the medium processing apparatus including:

a housing including a first end and a second end, the second end being opposed to the first end;

a placing section that is disposed between the first end and the second end, the placing section being a section on which the medium subjected to the process is to be placed;

a discharging section that is disposed between the first end and the placing section, the discharging section discharging the medium subjected to the process to the placing section;

an operation section that is disposed between the placing section and the second end, the operation section including a touch sensor, the touch sensor detecting an operation input; and an operation controller that controls operation of the operation section, in which a portion or all of the operation section overlaps the discharging section in a direction intersecting a direction from the first end toward the second end, and the operation controller limits, on the basis of size information, the detection operation performed by the touch sensor, the size information indicating information related to a medium size of the medium.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A medium processing apparatus including a processor that performs a process related to a medium, the medium processing apparatus comprising:

a discharging section that discharges the medium;

an operation section that is disposed downstream of the discharging section in a discharging direction and includes a touch sensor, the discharging direction being a direction in which the discharging section discharges the medium, the touch sensor detecting an operation input; and an operation controller that limits, on a basis of size information, detection operation performed by the touch sensor, the size information indicating information related to a medium size of the medium.

2. The medium processing apparatus according to claim 1, wherein the operation controller has a detection mode and a limiting mode, the detection mode allowing the touch sensor to detect the operation input, the limiting mode limiting the detection operation, the detection mode and the limiting mode each being to be set as an operation mode of the operation section, and the operation controller sets the operation mode to the limiting mode in a case where the medium size based on the size information is greater than a predetermined size.

3. The medium processing apparatus according to claim 2, further comprising:

a conveying section that conveys the medium along a conveyance path and thereby causes the medium to be discharged from the discharging section; and a medium sensor that is disposed on the conveyance path and detects the medium, wherein the operation controller determines, on a basis of a timing at which the medium sensor detects the medium, a timing to switch the operation mode from the detection mode to the limiting mode.

4. The medium processing apparatus according to claim 2, wherein the operation controller sets detection sensitivity of the touch sensor to first detection sensitivity in the detection mode, and the operation controller sets the detection sensitivity of the touch sensor to second detection sensitivity in the limiting mode, the second detection sensitivity being lower than the first detection sensitivity.

5. The medium processing apparatus according to claim 4, wherein the operation controller switches the operation mode from the limiting mode to the detection mode on a basis of a result of the detection operation performed by the touch sensor in the limiting mode.

6. The medium processing apparatus according to claim 4, wherein the operation controller includes a timer that performs counting operation, and the operation controller causes the timer to start the counting operation when the processor ends the process, and switches the operation mode from the limiting mode to the detection mode after the timer ends the counting operation.

7. The medium processing apparatus according to claim 6, further comprising an environment sensor that performs detection of an environment, wherein the operation controller configures setting of the counting operation on a basis of a result of the detection performed by the environment sensor.

8. The medium processing apparatus according to claim 4, wherein the touch sensor compares a detected value and a threshold with each other and thereby performs the detection operation, the operation controller sets the threshold to a first threshold in the detection mode, and the operation controller sets the threshold to a second threshold in the limiting mode, the second threshold being higher than the first threshold.

9. The medium processing apparatus according to claim 8, wherein the operation controller adjusts the second threshold on a basis of a result of the detection operation performed by the touch sensor in a case where the medium is discharged from the discharging section.

10. The medium processing apparatus according to claim 2, wherein the operation controller causes a process based on a result of the detection operation performed by the touch sensor to be effective in the detection mode, and the operation controller causes the process based on the result of the detection operation performed by the touch sensor to be ineffective in the limiting mode.

11. The medium processing apparatus according to claim 10, wherein the touch sensor includes two or more sensors, and the operation controller switches the operation mode from the limiting mode to the detection mode in a case where the two or more sensors are turned on in a predetermined sensor order.

12. The medium processing apparatus according to claim 11, wherein the two or more sensors include a first sensor and a second sensor, the first sensor being to be turned on first in the predetermined sensor order, the second sensor being to be turned on last in the predetermined sensor order, and the first sensor is disposed downstream of the second sensor in the discharging direction in the operation section.

13. The medium processing apparatus according to claim 10, wherein the touch sensor includes two or more first sensors and two or more second sensors, and the operation controller switches the operation mode from the limiting mode to the detection mode in a case where any of the second sensors is turned on after any of the first sensors is turned on.

14. The medium processing apparatus according to claim 13, wherein the two or more first sensors are disposed downstream of the two or more second sensors in the discharging direction in the operation section.

15. The medium processing apparatus according to claim 10, further comprising:

a speaker; and a speaker controller that controls operation of the speaker, wherein the speaker controller stops, in the limiting mode, the operation of the speaker based on the result of the detection operation performed by the touch sensor.

16. The medium processing apparatus according to claim 1, wherein the size information includes information related to a length of the medium in the discharging direction.

17. The medium processing apparatus according to claim 1, further comprising:

a conveying section that conveys the medium along a conveyance path and thereby causes the medium to be discharged from the discharging section; and a medium sensor that is disposed on the conveyance path and performs detection of the medium, wherein the operation controller generates the size information on a basis of a result of the detection performed by the medium sensor.

18. The medium processing apparatus according to claim 1, further comprising a communication section that performs communication with an information processor and thereby receives the size information from the information processor.

19. A medium processing apparatus including a processor that performs a process related to a medium, the medium processing apparatus comprising:

a discharging section that discharges the medium;

an operation section that includes a touch sensor, the touch sensor detecting an operation input; and an operation controller that controls operation of the operation section, wherein a portion or all of the operation section is covered with the medium in a case where a medium size of the medium discharged from the discharging section is greater than a predetermined size, and the operation controller limits the detection operation performed by the touch sensor in the case where the medium size is greater than the predetermined size.

20. A medium processing apparatus including a processor that performs a process related to a medium, the medium processing apparatus comprising:

a housing including a first end and a second end, the second end being opposed to the first end;

a placing section that is disposed between the first end and the second end, the placing section being a section on which the medium subjected to the process is to be placed;

a discharging section that is disposed between the first end and the placing section, the discharging section discharging the medium subjected to the process to the placing section;

an operation section that is disposed between the placing section and the second end, the operation section including a touch sensor, the touch sensor detecting an operation input; and an operation controller that controls operation of the operation section, wherein a portion or all of the operation section overlaps the discharging section in a direction intersecting a direction from the first end toward the second end, and the operation controller limits, on a basis of size information, the detection operation performed by the touch sensor, the size information indicating information related to a medium size of the medium.

* * * * *